United States Patent [19]

Bishop

[11] 4,340,313

[45] Jul. 20, 1982

[54] BUSINESS MACHINE PRINTING RIBBON SPOOL APPARATUS AND METHOD OF INKING THE TYPE SLUG IMPACT PORTION OF PRINTING RIBBONS

[75] Inventor: John W. H. Bishop, Milltown, N.J.

[73] Assignee: Ibex Inking Systems Corp., Edison, N.J.

[21] Appl. No.: 971,324

[22] Filed: Dec. 20, 1978

Related U.S. Application Data

[63] Continuation-in-part of Ser. No. 703,261, Jul. 2, 1976, abandoned.

[51] Int. Cl.[3] ..... A41J 31/14

[52] U.S. Cl. ..... 400/202.1; 400/202.3; 400/242

[58] Field of Search ..... 400/202, 202.1, 202.2, 400/202.3, 202.4, 207, 208, 208.1, 241.2, 242, 243, 244; 101/367; 156/73.2, 303.1

[56] References Cited

U.S. PATENT DOCUMENTS

| | | | |
|---|---|---|---|
| 1,304,367 | 5/1919 | Pullen | 400/202.4 |
| 1,713,277 | 5/1929 | Goldberg et al. | 400/242 X |
| 2,038,706 | 4/1936 | Beckman | 400/202.1 |
| 2,549,196 | 4/1951 | Harris | 400/202.1 |
| 2,667,257 | 1/1954 | Hurtado | 400/242 |
| 2,761,539 | 9/1956 | Furman et al. | 400/202.2 X |
| 2,869,706 | 1/1959 | Bishop | 400/202.1 |
| 2,964,157 | 12/1960 | Knight | 400/202.4 X |
| 2,965,911 | 12/1960 | Hempel et al. | 101/367 X |
| 3,042,180 | 7/1962 | Bishop | 400/244 X |
| 3,211,273 | 10/1965 | Bishop | 400/207 X |
| 3,330,791 | 7/1967 | Mater et al. | 400/241.2 X |
| 3,491,685 | 1/1970 | Tramposch | 101/367 X |
| 3,514,350 | 5/1970 | Bishop | 156/73.2 |
| 3,819,026 | 6/1974 | Ploeger et al. | 400/202.1 |
| 3,948,382 | 4/1976 | Nesbitt et al. | 400/202.4 |
| 3,977,512 | 8/1976 | Teagarden et al. | 400/208 X |
| 4,115,012 | 9/1978 | Ploeger et al. | 400/242 X |
| 4,127,337 | 11/1978 | Bishop | 400/202.4 |

FOREIGN PATENT DOCUMENTS

| | | | |
|---|---|---|---|
| 640284 | 4/1962 | Canada | 400/470 |

*Primary Examiner*—Ernest T. Wright, Jr.
*Attorney, Agent, or Firm*—David B. Miller; Philip Rodman

[57] ABSTRACT

A printing ribbon spool and method of replenishing ink to printing ribbons are disclosed. The spool has a central ink reservoir, and a pad of cellular material, preferably a spun-bonded fibrous material, which receives ink from the reservoir and has an exposed periphery beneath the lower edge of the ribbon as it pays on and off the spool. Ink is conveyed from the reservoir through the pad of cellular material to the exposed area of the pad, and a lower area of the ribbon contacts the exposed area of the pad to pick up ink therefrom and to transmit ink upwardly of the ribbon by capillary action to the type slug impact area of the ribbon. Preferably, both the supply ribbon spool and a take-up ribbon spool have a similar construction, so ink is supplied to the ribbon both as it is unwound from the supply spool and as it is wound up on the take-up spool. The ink reservoir can be closed for storage and shipping and opened when the spool is prepared for use.

48 Claims, 18 Drawing Figures

BUSINESS MACHINE PRINTING RIBBON SPOOL APPARATUS AND METHOD OF INKING THE TYPE SLUG IMPACT PORTION OF PRINTING RIBBONS

This patent application is a continuation-in-part of my copending U.S. patent application Ser. No. 703,261 filed July 2, 1976, now abandoned, whose disclosure is incorporated herein by this reference.

The present invention relates to a printing ribbon spool apparatus and to a method of inking the type slug impact area of printing ribbons, and is usable, for example, in business machines such as teleprinters, typewriters, accounting machines, computer and data printers and the like. More particularly, the present invention relates to a printing ribbon spool apparatus and method incorporating an ink reservoir in a spool and a means and method of transferring ink from the reservoir to the lower edge of the printing ribbon, and conveying it by capillary action to the type slug impact area of the printing ribbon.

Business machine ribbon re-inking devices of various forms have been proposed heretofore, but various disadvantages of the previously proposed devices have limited their usefulness. Among their disadvantages are: they did not distribute ink uniformly to the type slug area which resulted in lack of uniform density of print therefrom; they required refilling of ink reservoirs and this led to uncleanliness both of the machine and the operator; the re-inkers required special machine modifications, hence often they were not adapted for use of conventional machines; the supply of ink was directed closely adjacent the ribbon area where the type slug impacted, so excessive ink, and concommitant blotchy type, resulted.

Prior re-inking devices have not been widely accepted because of inherent limitations, some of which have been enumerated above, in the devices themselves and in their systems of operation. But the need for lengthened service life of the linked ribbon has never been greater than it is today. Until about the 1960's, conventional business machines operated at a printout speed of about seven to ten characters per second. This speed has increased rapidly in recent years to fifteen, twenty, thirty, one hundred twenty, and more, characters per second. A recent Teletype Corporation machine, model no. 40, is designed to print at 240 characters per second.

In a struggle to keep up with this "explosion" in printing speeds, manufacturers have experimented with replacements for the conventional inked ribbon. Ink encapsulated paper has been used, but the paper is expensive and the density of the printed character is poor. Non-impact systems using thermal, electrostatic or jet ink character fonts have also been used. Again, the paper is expensive, the print density can be poor and the systems to date have proven susceptible to mechanical problems.

So the conventional ribbons widely used today are still pre-linked ribbons which have been inked by immersing or otherwise impregnating the ribbon with a supply of ink, so that the entire supply of ink is that amount which can be carried by the ribbon on its surfaces and in the interstices of the ribbon and the ribbon roll. Such an inked ribbon, wound on a spool and encased in a suitable wrapper, is the one commonly used today on business machines.

When in the judgment of the machine operator, the machine no longer prints an output sheet of acceptable legibility or copying quality, the spent ribbon is removed and discarded, a new ribbon is unwrapped, attached to an empty spool and installed in the machine, and that new ribbon is used until the print quality is again deemed inadequate, at which point the cycle is repeated with a still further new ribbon. The cost of replacing ribbons includes not only the basic cost of the new ribbon, but also the cost in operator time necessary to replace the ribbon and the cost of machine "down time" while the ribbon is being replaced, and less obvious costs, such as pilferage which results when the need for frequent ribbon replacement leads a firm to maintain an open supply of new ribbon spools close at hand for ready replacement.

With the ever increasing machine print speeds, the running life of conventional ribbons is being constantly shortened and much more frequent replacement of ribbons is now becoming necessary.

In the past most machines were deemed to require ribbon replacement after about 750,000 characters had been printed. This number can vary 33% either way dependent on key impact force, ribbon tension, absorbency of the paper, machine heat, size of type face slugs, and in the case of matrix pin firing print heads, heat caused by friction of the firing pins. More frequent ribbon replacement resulting from current increasing speeds increases operator cost and machine "down time," so, as might be expected, manufacturers have attempted to counter this by designing their new machines to permit use of larger capacity ribbon spools capable of using longer ribbons. Formerly twelve yard ribbon lengths were conventional, but today's machines are being designed to use thirty-six to forty yard ribbons.

The ribbon art itself has also undergone change. Until the development of synthetic fibers, the principal ribbon fabric had been an all-cotton ribbon fabric, but today, this is more costly than the newer synthetic fiber fabrics. A cotton fabric has good ink absorbency, and therefore, it can print legibly for a relatively long time because it can be given a relatively large initial ink supply which it releases at a gradually degrading rate, but the cotton fiber itself cannot withstand continuous impact as well as the nylon fiber to be discussed below, and consequently, cotton ribbons have not proved generally suitable for apparatus and processes where ink is replenished and the ribbons, so to speak, re-vitalized. Ribbons are quite narrow, generally being one-half inch in width; generally, they are produced by weaving a wider fabric and then slitting this wider fabric into the required ribbon width. This method of manufacture can result in ribbons in which the edges fray relatively easily in use, so it has been the practice to bond the edges of cotton ribbon with an adhesive-like sealer. Even so, cotton ribbons have poor resistance to edge fraying under continuous use.

Ribbons of silk fiber have also been used. They have good strength, clarity and absorbency and medium resistance to fraying under continuous use. Again, the edges are bonded with an adhesive-like sealer to minimize fraying. As is well known, silk fiber although stronger than cotton, today is not plentiful, and it is expensive.

With the advent of synthetic fibers, nylon ribbons have been developed. The nylon fiber is very tough and can stand up to continuous impacting by the type slugs or firing pins. The nylon fiber also is thermoplastic, and the narrow ribbons are made by weaving a wider fabric and then slitting it to ribbon widths by hot rotary knives which not only "cut" the fabric but also melt and fuse together the fiber ends at the ribbon side edges which makes the ribbons almost fray-proof.

Woven nylon fabric ribbons have been found excellent for the ribbon used in this invention, and the preferred ribbon used in this invention is a nylon ribbon woven of continuous filament, multi-filament warp and weft yarns. The nylon fibers, i.e. filaments, do not absorb the ink but reject the same. Rather, the ink is held in interstices in the fabric; it is now believed the ink is held almost exclusively in the fabric interstices, as distinguished from the interstices within the individual yarns making up the fabric.

It is an object of this invention to provide a printing ribbon spool apparatus and method of inking the impact portion of a printing ribbon in which the ribbon's useful life before replacement is greatly lengthened as compare to a conventional ribbon. It is a further object of this invention to provide a printing ribbon spool apparatus and method of inking the impact area of a printing ribbon in which the useful life during which the ribbon prints type of acceptable legibility and copying quality more nearly approaches the life during which the ribbon can be impacted before physical damage to the ribbon fiber and fabric necessitates replacement.

A further object of the invention is to provide a printing ribbon spool apparatus and method of inking the impact area of a printing ribbon in which the length of time the printing ribbon spool apparatus can be shelf stored before use is greatly lengthened.

A still further object of the invention is to provide a printing ribbon spool apparatus and method of inking the impact area of a printing ribbon in which the combined ribbon, spool and ink reservoir can be economically produced, assembled, filled and shipped.

The foregoing and other objects and advantages of this invention are achieved in an apparatus and method in which a ribbon spool has an ink receptacle cavity of relatively large capacity in the hub of the spool, a thin washer-like ink pad of cellular material, preferably a fibrous material such as a spun-bonded fibrous sheet, or the like, is in communication with the ink receptacle, preferably at its bottom, and extends radially outwardly of the ink receptacle to have a portion thereof exposed in the path of the lower portion of the ribbon to contact, and apply ink to, that lower portion of the ribbon for the ink to be in turn conveyed upwardly through the ribbon by capillary action to the slug impact area of the ribbon. In the re-inking method of this invention, at least the lower edge, and preferably a surface of the lower part, of the ribbon contacts and preferably rubs, as exposed surface of the ink pad, at least intermittently, to deposit ink thereon from such ink pad.

In a preferred embodiment of this invention, the printing ribbon spool has a spool body with a hub having upper and lower flanges directed radially outwardly therefrom and adapted to receive a ribbon wound thereon between said flanges, and a thin washer-like ink pad supported adjacent the bottom flange and having a portion thereof exposed in ribbon contacting position and another portion in ink receiving communication with a central ink reservoir to receive ink from the reservoir and to convey the ink through the material making up the ink pad to the exposed ribbon contacting portion of the pad where the ink is picked up by a lower portion of the ribbon as it contacts the pad and is conveyed upwardly by capillary action to the type slug impact area of the ribbon. Preferably, both ribbon spools used on the machine have similar constructions, so that ink is delivered to the ribbon both as it is unwound from the supply spool and as it is wound up on the receiving spool. In this preferred embodiment, ink is transferred from the reservoir to the ink pad at the portion communicating with the reservoir, it is conveyed through the pad to the portion of the pad which is exposed in a position to contact a bottom portion of the ribbon; the ink is delivered from that exposed portion of the pad to the bottom portion of the ribbon as it contacts and rubs thereacross, and the ink is conveyed upwardly from the bottom portion of the ribbon to the type slug impact area of the ribbon by capillary action. In the embodiment using two such pads, ink is so delivered to the ribbon both as it is being unwound from the supply spool and as it is being wound up on the receiving spool.

The invention will be better understood from the following detailed description of specific embodiments thereof when read in conjunction with the accompanying drawing, in which.

Figure 5:
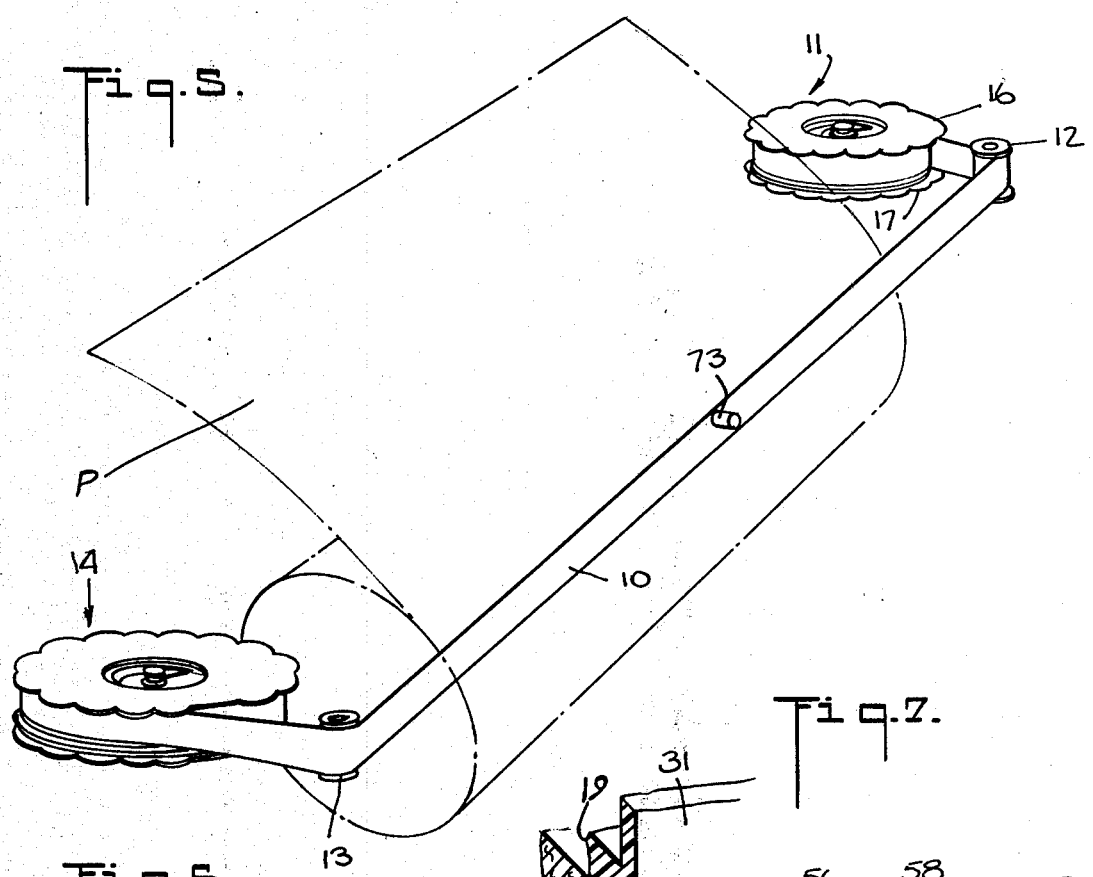
FIG. 5 is a schematic view of a supply spool and a wind up spool illustrating the ribbon passage therebetween and past the type slug impact position of the business machine.
Figure 7:
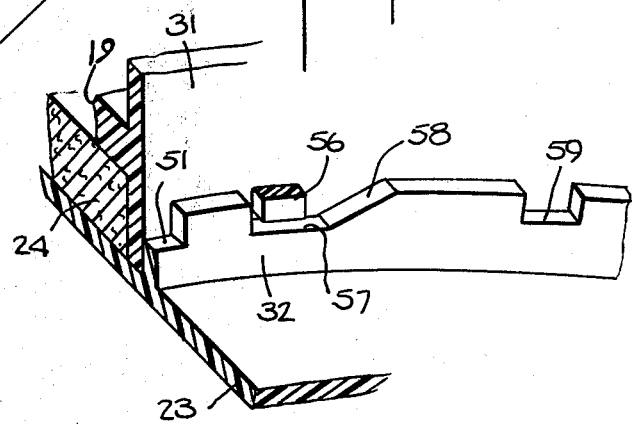
FIG. 7 is an assembled perspective view of the elements shown in FIG. 6 with the notches in the annular ribs out of alignment in their closed position.
Figure 6:
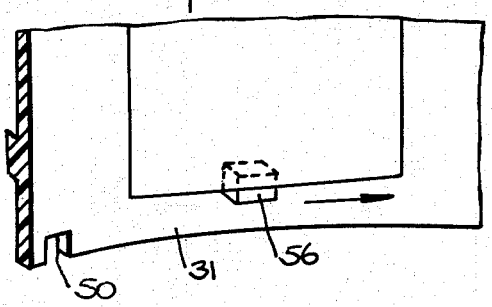
FIG. 6 is a detail exploded perspective view of cooperating ink reservoir closing ribs on the cap and the ink reservoir unit illustrating the ink egress passages and a locking device employed in this first embodiment.
Figure 6:
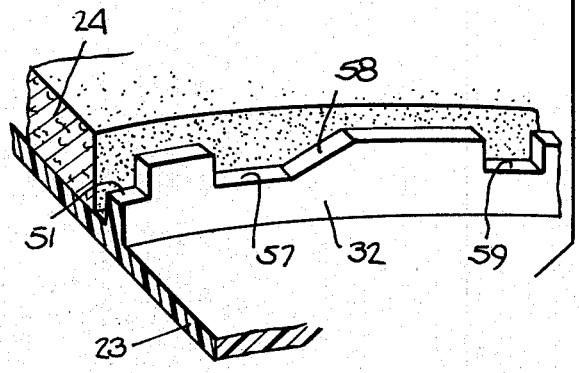
Figure 8:
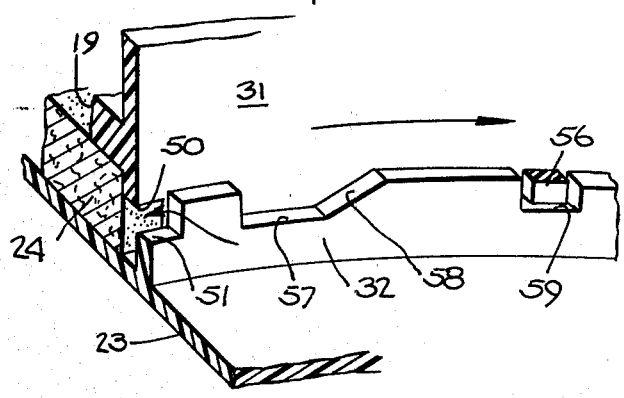
FIG. 8 is an assembled perspective view of the elements shown in FIG. 6 with the notches in the annular ribs aligned in the open position to permit flow of ink from the reservoir.

Referring to the drawing in detail, as illustrated schematically in FIG. 5 of the drawing the inked ribbon 10 is led from a supply printing ribbon spool 11 past a guide, such as the machine ribbon roller 12 to the type slug impact position. There the type slug 73 impacts against the ribbon 10 and the underlying paper P to print with the ribbon's ink on the underlying paper P the character found on the type slug 73. After the ribbon 10 leaves the type slug impact position, it passes to a second guide 13 and then to a wind-up printing ribbon spool 14. Although one of the spools 11, 14 can be a conventional spool, it is preferred that both ribbon spools 11, 14 embody the novel structure of this invention, so ink is supplied to the ribbon 10 both as it is unwound from the supply spool 11 and as it is wound up on the wind-up spool 14. Also, although for ease of description herein the spool 11 is designated as a supply spool and the spool 14 is designated as a wind-up spool, in practice, business machines are so constructed that the ribbon 10 is unwound from one spool and simultaneously wound up on the other until nearly all of the ribbon 10 has passed from one spool to the other at which point a mechanism is actuated to reverse the ribbon 10 and unwind it from the former wind-up spool and wind it up on the former supply spool, and in this way in normal operation of the business machine the ribbon 10 passes back and forth continually from spool to spool until it is deemed no longer usable. When two spools of this improved design are used in an installation, they will ordinarily be identical, and, therefore, for purposes of illustration, only one will be described in detail herein.

Figure 1:
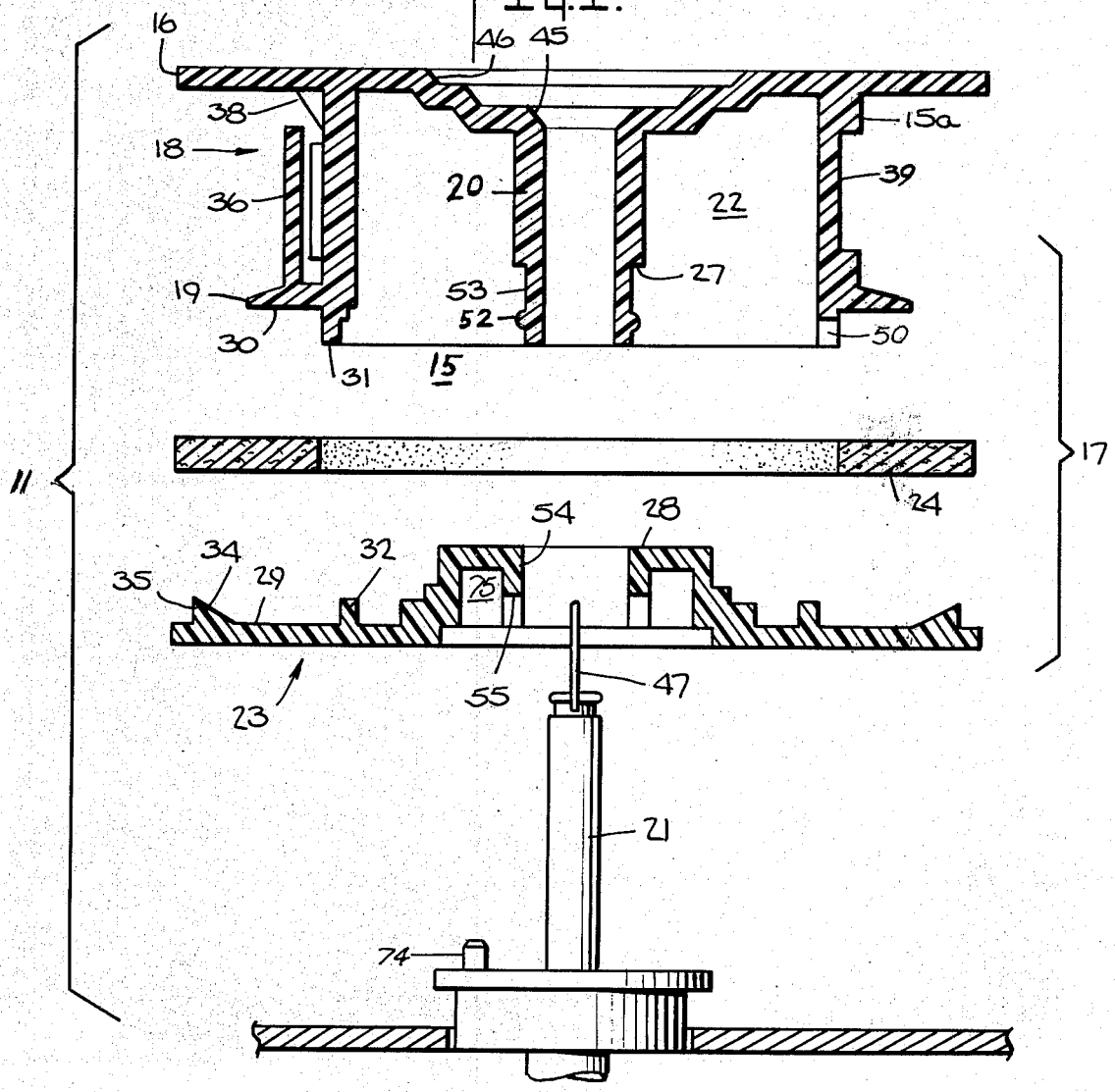
FIG. 1 is an exploded axial cross-sectional view of a first embodiment of a printing ribbon spool according to this invention taken along a diameter of the spool.
Figure 3:
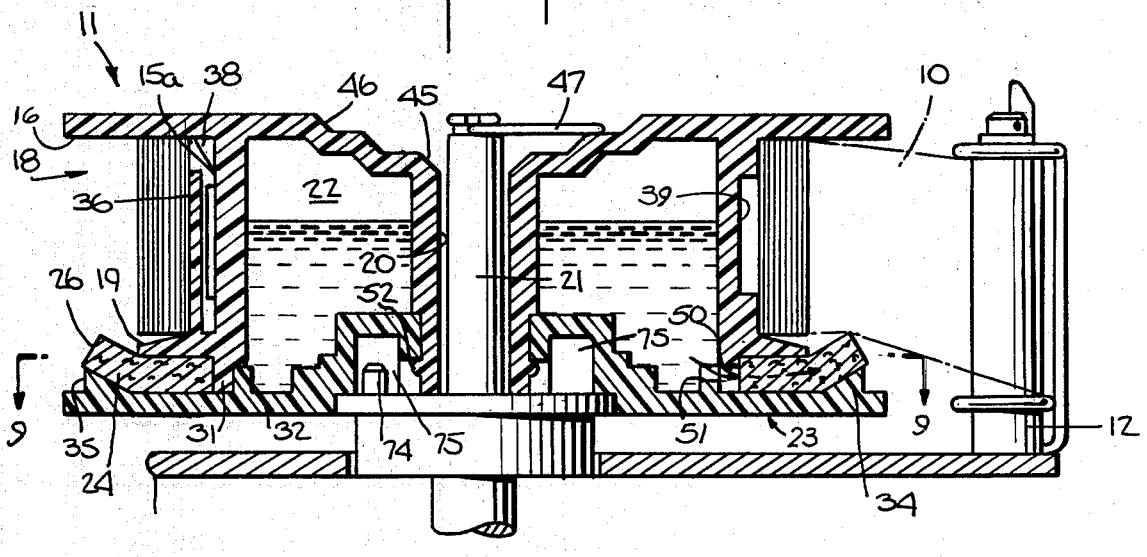
FIG. 3 is an assembled view of the printing ribbon spool of FIG. 1 filled with ink and positioned on a spindle with the ribbon wound thereon extending to a ribbon guide roller as in use on a business machine.

Referring to FIGS. 1 and 3, the improved printing ribbon spool 11 of this invention includes a hollow generally cylindrical hub 15 having a pair of axially spaced flanges 16, 17 extending outwardly therefrom at the top and bottom of the hub 15 to provide a ribbon receiving channel 18 between the flanges 16, 17 and the outer surface of hub 15. As will become apparent as this description proceeds, when the ribbon spool 11 of this invention is used the flange 16 will be higher than the flange 17, so the flange 16 will be designated herein as the upper flange, and when the term lower flange is used herein, it will refer to flange 17 or one or more of its elements, such as flange 19.

As is customary, the ribbon spools 11, 14 are generally cylindrical in overall external outline, although, desirably, flanges 16, 17 are scalloped at their peripheries for ease of grasping for a purpose which will become apparent as this description proceeds. Also, the lower flange 17 is a compound structure which includes an outwardly extending flange element 19, that it itself a flange; flange element 19 is of slightly smaller diameter than the upper flange 16, for a purpose which will become apparent as this description proceeds; the ribbon 10 is wound in a channel 18 between hub 15, flange 16 and flange element 19.

The ribbon spool 11 has a central, generally cylindrical, spindle tube 20 which, as appears from FIG. 3 is slightly larger in internal diameter than the external diameter of the business machine spindle 21 and is adapted to receive that spindle 21 when the spool 11 is on the business machine as has been the case in the spindle tube of the ribbon spools commonly used heretofore. A drive pin 74 nests in one of the several drive sockets 75 in the underside of the spool 11. The wall **15*a* that forms the ribbon receiving surface of hub 15 is much larger in diameter than the spindle tube 20, so there is provided a relatively large cavity 22 between the spindle tube 20 and the hub wall 15*a* which cavity 22 forms the ink reservoir of this invention. The top of this ink reservoir 22 is closed by an inward continuation of the upper flange 16, but in the configuration shown for a purpose to be described. Conveniently, the hub 15, hub wall 15*a*, spindle tube 20, upper flange 16 and lower flange element 19** can be formed in a single body unit as, for example, by molding it in a single piece from a suitable material, such as acetal resin which is found eminently suitable because of its chemical inertness to dye-based inks commonly used.

A "cap" 23 is provided to generally close the ink reservoir 22 but with an important exception to be described, and to complete the overall ribbon spool configuration. Although element 23 is called a "cap" herein, when the ribbon spool 11 is in use, cap 23 is disposed at the bottom of the ribbon spool 11 rather than at the top where "caps" are normally found. But when assembling the spool 11, the preferred unitarily molded upper flange 16, hub 15, hub wall **15*a*, spindle tube 20 and lower flange element 19 are positioned inverted with element 19 and the open end of the ink reservoir 22 uppermost. In this position the ink metering washer-like pad 24, to be described, is placed atop flange element 19 with its inner periphery surrounding rib 31, the ink reservoir 22 is "pour" filled with ink, the cap 23 is then put on and united with, the unitarily molded body unit to complete the assembled ribbon spool 11 which is then stored in this same, inverted position with the lower flange element 19 above the upper flange 16 until the spool 11 is ready for use, at which time the spool 11** is inverted to its normal use position shown in the drawing.

The wall of hub 15 forming spindle tube 20 is stepped to provide a shoulder 27 near its lower end which acts as a stop for a mating shoulder 28 on the cap 23, so that when the cap 23 is assembled to the remainder of the spool 11, the shoulders 27 and 28 abut. The cap 23, spindle tube 20 and lower flange element 19 preferably are so proportioned that when the shoulders 27, 28 abut, the upper surface 29 of the cap 23 is spaced from the lower surface 30 of the lower flange element 19 a distance equal to, or slightly more than, the design thickness of the metering washer 24; conveniently, in this first described embodiment the washer can be 0.075" thick and the gap can be 0.080".

A unique feature of the ribbon spool embodiment shown in FIGS. 1 and 3 is that when assembled and filled with ink, its ink reservoir 22 can be completely closed to prevent ink leakage in storage and shipping, yet when the ribbon spool 11 is to be used, the operator can open the ink reservoir 22 to permit ink flow to the metering pad 24 by simply twisting flange 16 and cap 23 relative to each other. The construction which permits this is best illustrated in FIGS. 1, 3 and 6 through 10. As best appears in FIGS. 1 and 3, the lower flange element 19 has a downwardly extending circular rib 31, and the cap 23 has an upwardly extending circular rib 32. The elements are proportioned and arranged such that in the assembled position shown in FIG. 3, rib 32 fits snugly inside rib 31 to completely seal the ink reservoir 22 against leakage save at the ink feed openings to be described. As appears best in FIGS. 7, 10 and 11, rib 31 has one or more notches 50 extending therethrough at its lower edge. In the embodiment illustrated, and as appears in FIGS. 9 and 10, three such notches 50 are provided. As best appears in FIGS. 6 through 10, rib 32 has one or more notches 51 extending therethrough at its upper edge. In the embodiment illustrated, and as best appears in FIGS. 9 and 10, three such notches 51 are provided through the upper edge of rib 32.

In one embodiment of the assembled ribbon spool 11, the lower surface of rib 31 contacts the upper surface 29 of cap 23 except at the notches 50. In one specific application, rib 32 extends upwardly 0.08" from the surface 29, the width of notches 50 is ⅛" measured along the center line circumference of rib 31 and the notches 50 are 0.06" deep measured axially from the lower surface of rib 31. In this same specific application, the three notches 51 similarly are ⅛" wide measured along the center line circumference of rib 32 and are 0.04" deep measured axially from the upper surface of rib 32. The three notches 50 in this application are spaced 120° apart around rib 31; similarly, the three notches 51 are spaced 120° apart around rib 32.

Figure 9:
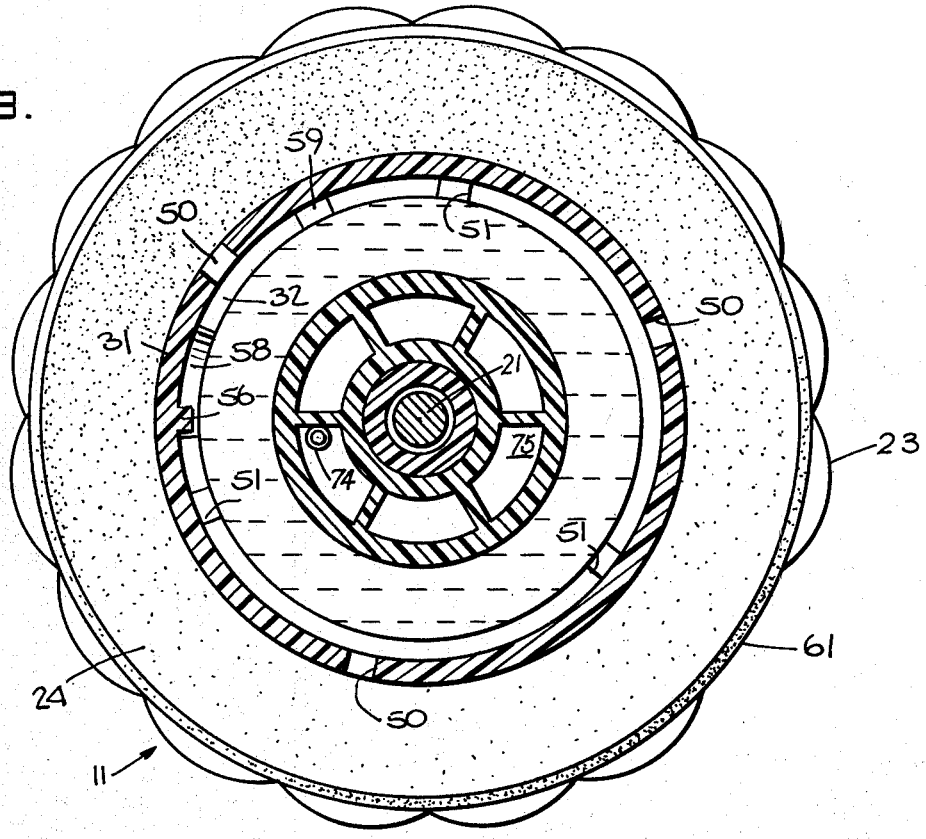
FIG. 9 is a cross-sectional view taken along the line 9—9 of FIG. 3 and corresponding to FIG. 7 with the notches in the annular ribs in their closed position.
Figure 10:
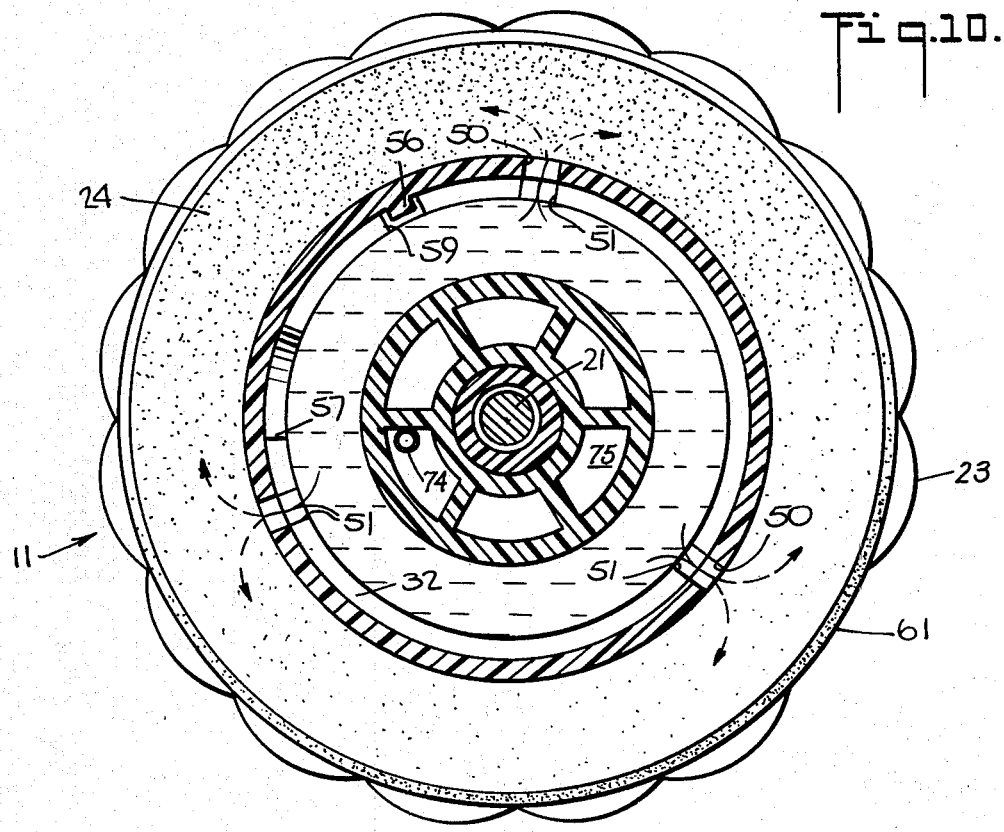
FIG. 10 is a cross-sectional view taken along the line 9—9 of FIG. 3 and corresponding to FIG. 8 with the notches in the annular ribs in their open position.

It will be apparent from the foregoing that the cap 23 can be rotated relative to the hub or reservoir body unit 15 so that the notches 51 and 50 may be disposed in non-aligning relationship as shown in FIG. 9, so that no egrees from reservoir 22 is provided for the ink therein, or alternatively, the cap 23 and reservoir body unit 15 may be rotated so that notches 50, 51 are aligned as illustrated in FIG. 10 to allow ink to flow from reservoir 22 through the three egress passages provided by aligned notches 50, 51 to the washer 24.

The cap 23 and reservoir body unit 15 are assembled so these elements may be rotated with respect to each other. As best appears in FIG. 1 hub, or reservoir body unit, 15 has a rib 52, semi-circular in cross-section, on an inner cylindrical surface 53 depending from shoulder 27. Cap 23 has a cylindrical surface 54 depending from shoulder 28, and this surface 54 has substantially the same internal diameter as the external diameter of surface 53. In assembly, cap 23 is press fit on to the spindle tube 20 by forcing shoulder 28 and surface 54 over the rib 52. The flexibility of the elements allows the shoulder 28 and surface 54 to be pressed past rib 52, but once past, rib 52 moves back to lock cap 23 in place. The elements are proportioned and arranged so that when fully assembled, the lower surface 55 on cap 23 substantially abuts the upper portion of rib 52 so that cap 23 is held firmly in place on reservoir body unit 15 but is free to rotate with respect thereto.

Means are provided to lock the ribbon spool 11 with the ink reservoir 22 in either the open or the closed position. When assembled for storage and shipping, the elements will be locked in the "closed position." As best appears in FIGS. 6–8, the rib 31 has a block 56 projecting inwardly therefrom, and the rib 32 has a first locking notch 57 through its upper surface, an upwardly sloping face 58 at one side of this first locking notch 57 and a second locking notch 59 spaced from the first locking notch 57 on the side thereof at which the upwardly sloping face 58 is found.

The elements in one application are so constructed and arranged that when the reservoir 22 is closed with the notches 50, 51 totally out of alignment, i.e. when each notch 50, 51 is closed by a section of the rib 31, 32 it faces, the block 56 rests in the first locking notch 57. But the rib 31, and block 56 can be moved in the direction indicated by the arrow in FIG. 6 to slide block 56 up surface 58 and over the upper edge of rib 32 until it falls into the second locking notch 59. The elements are so constructed and arranged that when block 56 lies in the second locking notch 59, the notches 50, 51 are aligned to permit ink to flow out of the reservoir 22.

Figure 2:
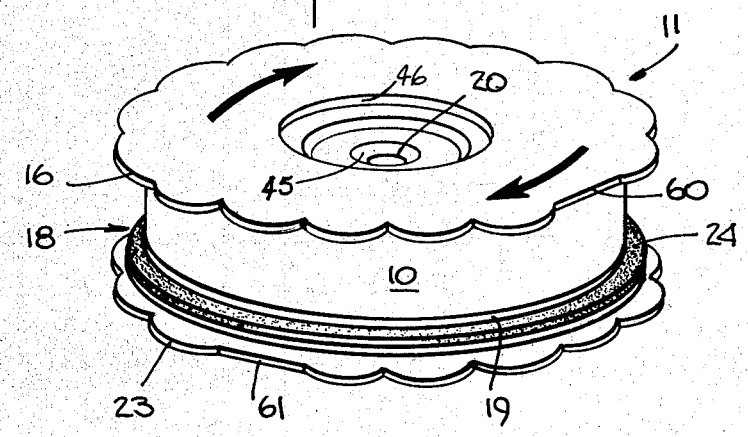
FIG. 2 is a perspective view of the assembled printing ribbon spool of FIG. 1.

When assembled, the unit is closed with block 56 in notch 57. The user, when installing the ribbon spool 11 simply grasps the flange 16 and cap 23 and turns them relative to each other until block 56 falls into the second locking notch 59. Arrows, as illustrated in FIG. 2, can be provided to assist in this operation, and the flange 16 and cap 23 can have two flats, 60, 61 in their otherwise scalloped periphery positioned so that when the reservoir 22 is open, the flats 60, 61 are aligned. Additionally, in the construction illustrated, the notches 57, 59 and surface 58 effectively permit relative movement in only one direction from the fully closed position, and when in the fully open position permit no relative movement. Finally, a block 56 rides up surface 58 the elements are bent apart slightly so that when block 56 finally falls into the second locking notch 59, it does so with an audible "click".

It is an important element of this invention that an ink pad is supported adjacent the bottom flange element 19 and having a portion thereof exposed in ribbon contacting position and with the ink pad communicating in ink-receiving relation with the ink reservoir 22. Conveniently, this is accomplished in the preferred embodiment by the metering washer-like pad 24. In one application this washer 24 has an internal diameter substantially equal to the external diameter of rib 31, so that ink flowing through the passages formed by registering notches 50, 51 flows to, and is picked up by, the metering washer 24. The metering washer 24 is cylindrical in overall outline, but annular in plan, and has an external diameter such that it is exposed to the ribbon 10 as ribbon 10 passes to or from the hub wall 15*a* at the ribbon receiving channel 18.

In the embodiment of FIG. 1, the metering washer 24 has an external diameter slightly larger than the diameter of the lower flange element 19 and approximately the same as the outer diameter of the cap 23, so that when the ribbon spool 11 is assembled, the radially inner area of the metering washer 24 receives ink from the ink reservoir 22 and the radially outermost area of the metering washer 24 is exposed between the radially outermost perimeter of the lower flange element 19 and the radially outermost perimeter of the cap 23. In the embodiments shown, the cap 23 and lower flange element 19 are constructed to tilt or cock the outer periphery of the metering washer 24 upwardly at a slight angle; in the embodiment of FIG. 1 an inverted generally V-shaped portion 26 of washer 24 is presented to the ribbon 10 as ribbon 10 passes across this V-shaped portion 26. At its outer periphery, cap 23 has an upwardly projecting circular rib 34 which, as shown, is triangular in radial cross-section and slopes upwardly from the surface 29 to provide an enlarged thickness at the radially outermost periphery 35 of the rib 34. The outer periphery of flange element 19 terminates in the axial cylinder in which rib 34 commences. The rib 34 and element 19, as appears best in FIG. 3, cooperate to tilt or cock up the outer periphery of washer 24 to present the inverted V-surface 26 of washer 24 to the ribbon 10.

When the spool 11 is assembled in operating position, ink in the ink reservoir 22 flows to the metering pad 24 at the pad 24's radially inner area, and the ink passes through pad 24 to the exposed periphery 26 thereof.

Various materials are suitable for the metering pad 24. Micro-cellular polymeric materials have been used. One such commercially available product is the sponge-like urethane elastomer cellular material available under the trade name "Micro-well". This product, described at p. 12, December 1970 MODERN PLASTICS and in the technical literature of H. M. Storms Corp., Newport, New York, and of its current supplier Micro-well, Inc., Miamisburg, Ohio, is a sponge-like material of polyurethane elastomer containing myriad microscopic pores; as much as 70% of the volume of the material is void. The voids, or pores, as appears in electron micrographs, interconnect and are irregular in shape and of various sizes; in one construction the voids have a pore "diameter" in the range of 13–14 microns. The product can be produced in annular cylinders, so it is a simple matter to slice from such cylinders thin washers suitable for use in this invention as the pads 24.

Another suitable product, available commercially under the name "Accuflo" from Porelon Inc. of Racine, Wisconsin is a similar microporous polymeric material with interconnecting voids. This plastic sponge-like material also can be manufactured in annular cylinders from which the washers 24 can readily be sliced.

As is well-known, these micro-cellular polymeric materials are somewhat soft and spongy to the touch, although finished products of varying hardnesses can be manufactured. Thus, Micro-well can be manufactured in a Shore A durometer of 27; Accuflo is supplied in hardnesses in the range of 11 to 40 Shore A durometer, but it can be manufactured as high as 70 Shore A durometer. The relatively softer A durometer hardnesses of Accuflo are suitable for the pads 24 of this invention.

Although these micro-cellular polymeric materials have been used for the ink metering pad 24 of this invention, the now preferred materials for this metering pad are thin fibrous pads. The spunbonded fibrous materials work well as the preferred fibrous pads of this invention. Such spunbonded fibrous materials are available in various constructions and under various trademarks. Thus, the DuPont Company offers a spunbonded polyester fibrous sheet under the trademark Reemay, and a spunbonded olefin fibrous sheet under the trademark Tyvek, and a spunbonded polypropolene fibrous sheet under the trademark Typar. These fibrous sheet products and their properties are described in the bulletins of: Textile Fibers Department, Spunbonded Products Marketing, E. I. DuPont de Nemours & Co. Inc., Wilmington, Del. 19898, U.S.A. One such DuPont bulletin is: "Properties and processing of REEMAY spunbonded polyester" Bulletin S-13 of August 1974; another is: "The properties and processing of TYVEK spunbonded olefin" Bulletin S-10 of December 1973; still a third is: "Typar spunbonded polypropolene" No. E-01740; these bulletins are incomporated herein by this reference.

As described in these bulletins, spunbonded fibrous sheets are formed by first spinning continuous bands of very fine, interconnected fibers and then bonding them together, as with heat and pressure. The strands or fibers in the sheet are randomly arranged, highly dispersed and bonded at the filament junctions. The chemical and thermal properties of the sheets are essentially those of the fiber employed, but their spunbonded structure gives them a pore structure and porosity making them highly suitable for the ink pad 24 of this invention. The REEMAY sheet has a fibrous appearance and feel to the naked eye and hand, and it is believed to have relatively large pores. The TYVEK sheet has the appearance and feel to the naked eye and hand of a somewhat paper-like product. When used in this invention, the REEMAY sheets transmit ink more freely than the TYVEK sheets. It is currently believed this is due to the surface characteristics of the REEMAY sheets.

Both the micro-cellular polymeric materials described above and the preferred fibrous materials described above have myriad small voids that interconnect and permit the pad to transmit ink as required in this invention.

The foregoing materials work quite satisfactorily in this invention using an ink in which a dye is dissolved in oleic acid. This preferred ink has a long shelf-life in the ribbon spools 11 of this invention, for the ink in the reservoir 22 of the assembled ribbon spool 11 is not exposed to the open air.

Figure 4:
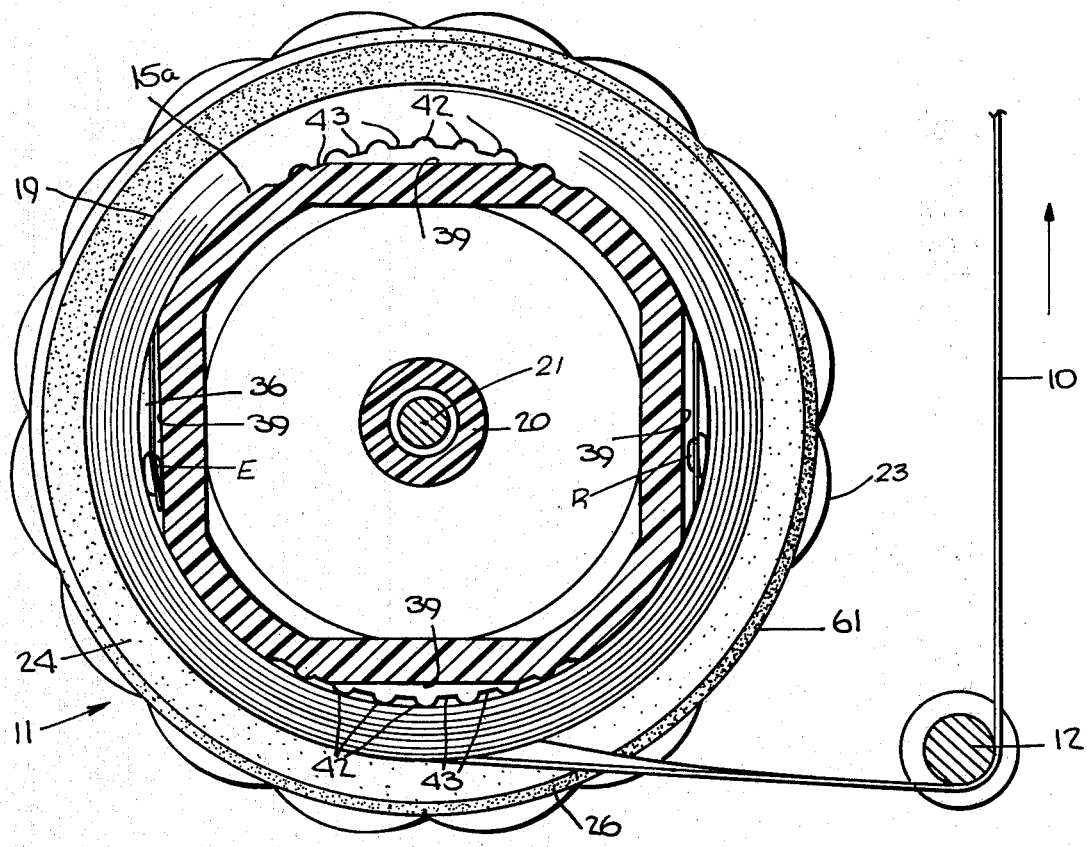
FIG. 4 is a top plan view of the printing ribbon spool of FIG. 1 with the upper flange broken away to show the structure of the ribs and grooves that drain ink squeezed from the ribbon.

As will be apparent from FIG. 3, the guide roll 12 is somewhat lower than the ribbon spool 11 in the operating position, so that the ribbon 10 does not approach the generally cylindrical surface of hub wall 15*a* in a direction normal to such surface, but rather approaches it from slightly below so that the lower edge of ribbon 10 is made to rub across the exposed outer edge of the pad 24. As the ribbon 10 rubs across inverted V-shape section 26, it compresses pad 24, and ink is transferred from the pad 24 to the ribbon 10. As appears in FIG. 4, this contact bends the ribbon 10 over slightly where it rubs across the exposed portion 26 of pad 24. The amount of this bend is slight; for a ribbon ½" wide, approximately ⅛" is bent over so that ⅛" of ribbon 10 rubs the exposed portion 26 of the pad 24, and ink is transferred to this bottom area of the ribbon 10 as it rubs the pad 24. The thus received ink is conveyed upwardly of the ribbon 10 by capillary action in the ribbon 10 to the type slug impact area of the ribbon 10 thereabove. Instead of advancing the ribbon 10 from a fixed lower point, some business machines reciprocate the ribbon guide axially to the guide at the type zone, so the ribbon 10 approaches wall 15*a* intermittently from below. In such machines, the ribbon 10 may contact and squeeze the exposed area 26 of the pad 24 intermittently to pick up ink therefrom.

As described above the ribbon 10 may be attached to the spool 11 by various means. A convenient way to attach the ribbon 10, however, and the one which is illustrated in the drawing, is to attach a small metal eyelet E near the end of the ribbon 10. This eyelet E can then be captured, by a mechanism next to be described, at the first turn of the ribbon 10 wound on the spool 11.

Figure 11:
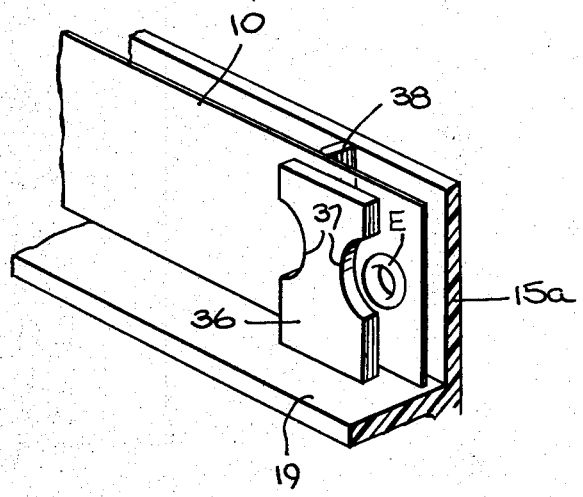
FIG. 11 is a detail view illustrating the notched ribbon attaching arm.

The spool 11 has an anchoring means for attaching the ribbon 10 to the spool hub 15. This anchoring means can be constructed in various way; for example, it may be made according to applicant's prior U.S. Pat. No. 3,042,180, or according to applicant's prior U.S. Pat. No. 3,211,273, or the preferred nylon ribbon can be attached by means of the sonic sealing system disclosed in applicant's prior U.S. Pat. No. 3,514,350. The anchoring means shown in the drawing includes a ribbon attaching arm 36 having two opposed notches 37 to receive an eyelet E, attached to the ribbon 10 near its end, in one or the other of the notches 37. The arm 36 as appears in FIGS. 1 and 11 is spaced a little distance from the outer surface of hub wall 15*a* and is fastened to the lower flange element 19 and projects upwardly therefrom to terminate a little distance from the lower surface of the upper flange 16, so that a narrow space is provided between the upper end of arm 36 and the lower surface of flange 16 through which one can slide the ribbon 10 so the ribbon 10 does not readily become detached from the spool 11 although it can be removed when desired. To further minimize the ribbon 10 becoming detached from the spool 11, a fin 38 is located in the corner between flange 16 and the hub wall 15*a* opposite arm 36. This fin 38 permits the thin ribbon 10 to be slid through the narrow gap between the upper end of arm 36 and the fin 38.

The hub wall 15*a* is generally cylindrical in outline, but it has one or more flats 39 to accommodate one or more eyelets, such as the aforesaid attaching eyelet E as well as a reversing eyelet R generally called for by the machine design, fixed to the ribbon 10. In the embodiment shown, four flats 39 are provided spaced ninety degrees apart. These flats 39 form planar indentations from hub wall 15*a*'s otherwise generally cylindrical surface so that a cavity is provided to accommodate the bulge caused by these eyelets E,R.

In a further departure from the otherwise general cylindricality of the outer surface of hub wall 15*a*, that wall 15*a* has a corrugated configuration at one or more selected areas to provide radially outwardly projecting ridges 42 and valleys 43 therebetween. In a preferred embodiment, these ridges 42 and valleys 43 are provided at two diametrically opposite areas of the spool 11 and are spaced ninety degrees from the anchor arm 36. Preferably, a depressed flat 39 occurs also at these two areas so the ridges 42 and valleys 43 at each of these areas are formed in two narrow bands of the generally cylindrical outer surface of wall 15*a*, one band above and the other below the flat 39.

The construction of the ribbon spool 11 with flats 39 as shown in the drawing accommodates the customary reversing eyelet R by allowing it to seat at a flat 39. In winding a ribbon 10 on a ribbon spool 11, tension in the ribbon 10 subjects successive convolutions of the ribbon 10 to pressure to squeeze out ink from the convolutions. If the following convolution is already saturated, the squeezed ink will simply lie on the surface producing blotted printout. In the industry, this condition is known as "puddling;" the corrugations 42, 43 allow this excess ink to drain back to the pad 24.

Referring to FIGS. 2 and 3, it will be noted the spool 11 has an enlarged generally frusto-conical first surface 45 at the upper end of the spindle tube 20, and above that surface 45 it has a second, and still larger, generally frusto-conical surface 46. Many business machines have a locking mechanism at the upper end of the spindle 21 to lock the spool 11 on the spindle 21. In the machine illustrated, the spindle 21 has a locking pin 47 that can be pivoted from the locked position shown in FIG. 3 to a vertical, unlocked position. The enlarged cavity provided by surface 46, as appears from FIG. 3, accepts the locking pin 47 in locked position; the enlarged cavity provided by surface 45 accommodates the heel of a locking pin 47 as the locking pin 47 is rotated from the locked to the unlocked position or vice versa.

The embodiment of the printing ribbon spool 11 depicted in FIGS. 1 and 3, with the ink reservoir sealing ribs 31, 32 detailed in FIGS. 6–10 permits leakproof shipping and storage of filled spools 11. But these features add to the cost and the invention can be manufactured in other embodiments.

Figure 12:
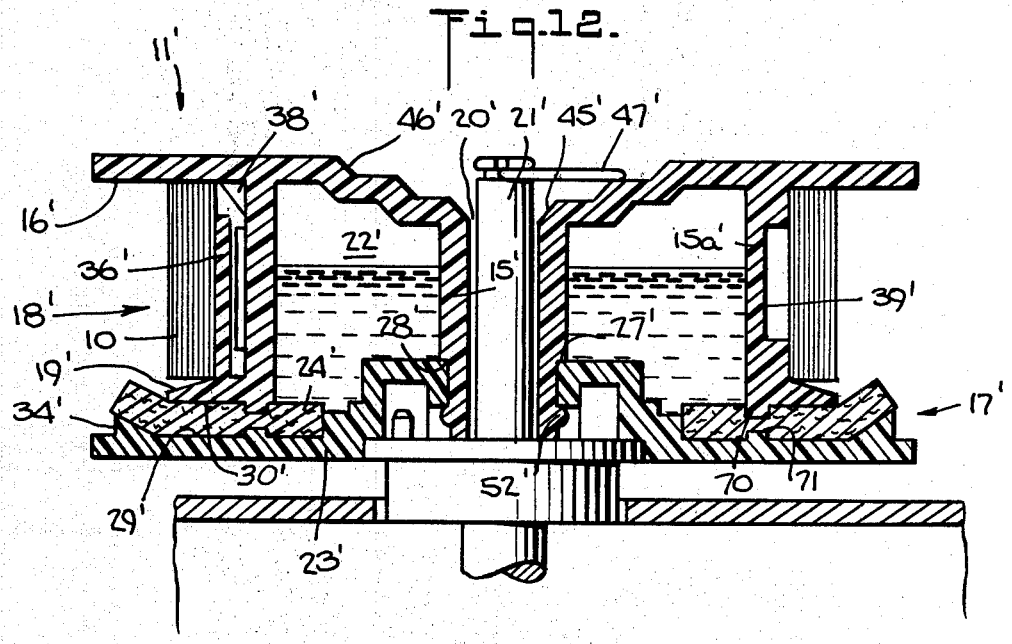
FIG. 12 is an assembled view similar to FIG. 3 of a second embodiment of a printing ribbon spool according to this invention.

A second embodiment omitting these features is shown in FIG. 12 and corresponds generally to the embodiment shown in FIG. 3, and has like parts. Therefore, in FIG. 12 the elements of this embodiment have been given the same reference characters as their respective corresponding elements in the embodiment illustrated in FIG. 3, but with the addition of a prime mark. Thus, the spool 11' has a hub 15', a hub wall 15*a'*, flanges 16', 17', with a channel 18' therebetween, a flange element 19', a spindle tube 20' and spindle 21', an ink reservoir cavity 22', a tape retention arm 36' with associated fin 38' and flats 39', with locking pin 47' and frusto-conical surfaces 45' and 46'.

The cap 23' also has a shoulder 28', and the body assembly has a shoulder 27' and a rib 52' for the same purpose as in the embodiment of FIG. 3, but in the embodiment in FIG. 12, the parts are constructed and arranged such that there is a gap between the lower surface of flange element 19' and the upper surface 29' of cap 23' which is equal to the design thickness of the metering washer 24'. Thus, when a metering washer $\frac{1}{8}$" thick is to be used, the gap between the lower surface 30' of flange element 19' and the upper surface 29' of cap 23' would be $\frac{1}{8}$". The central opening in washer 24' is sufficiently small in the embodiment of FIG. 12 that part of the washer 24' actually lies in the ink reservoir 22' at the bottom thereof. The hub wall 15*a'* has a depending circular rib 70 disposed opposite thereto. The rib 71 in the embodiment illustrated in FIG. 12 functions as a sealing rib to seal the lower surface of metering washer 24' against ink leakage therepast and to accommodate manufacturing tolerances. The depending rib 70 serves a similar purpose to seal the upper surface of metering washer 24' against ink leakage therepast. Together ribs 70, 71 serve as dams to prevent ink leakage along the surface of the metering pad 24' and compensate for variations in manufacturing tolerances in the washer 24' and the spool 11' so that the surface of metering pad 24' is always contacted or compressed slightly by the ribs 70, 71 to prevent ink leakage from the reservoir 22'. In one application, the spool elements are so proportioned that when the shoulders 27', 28' abut to provide a design gap spacing between the lower surface 30' of flange element 19' and the upper surface 29' of cap 23' equal to 0.08" to receive an 0.08" thick metering washer 24', ribs 70, 71 each project 0.02", so the design gap between ribs 70, 71 is 0.04" and a seal between ribs 70, 71 and the surfaces of washer 24' is assured.

Figure 13:
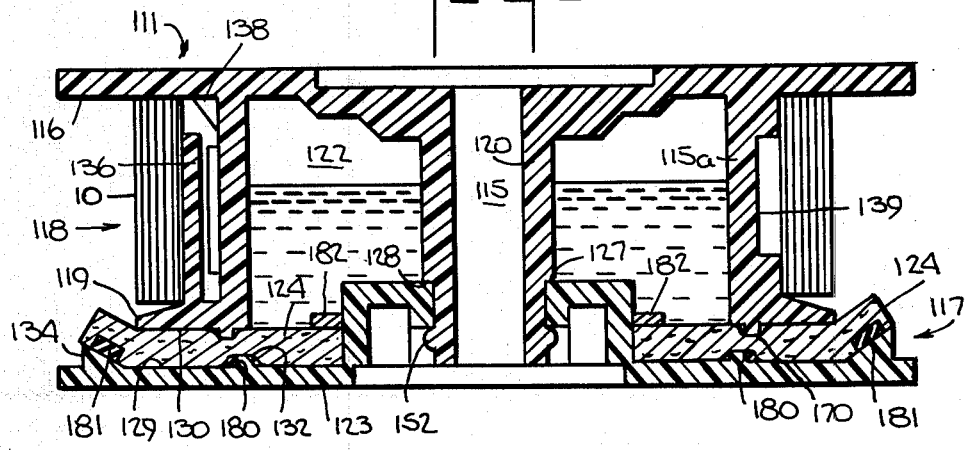
FIG. 13 is an axial cross-section view of a third embodiment of a printing ribbon spool according to this invention showing a now-preferred construction.
Figure 14:
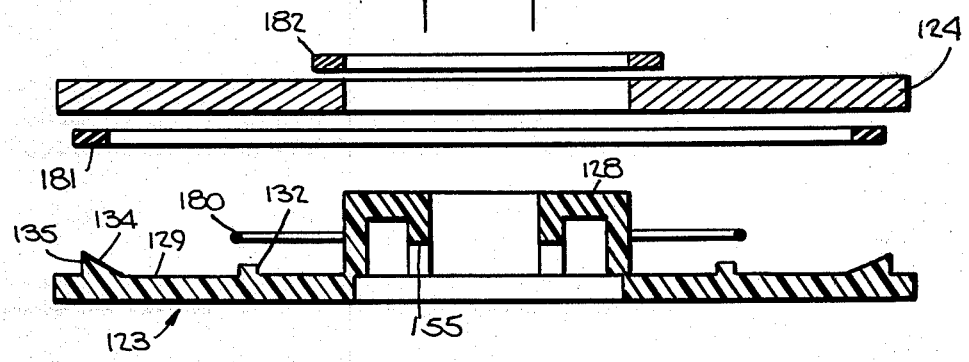
FIG. 14 is an exploded perspective view of the cap, gasket, booster and pad sub-assembly shown in FIG. 13.
Figure 15:
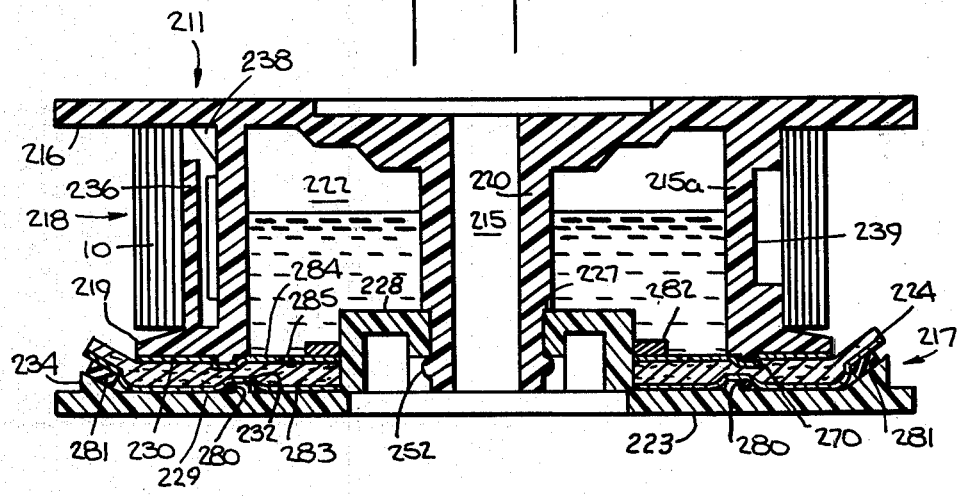
FIG. 15 is an axial cross-section view of a fourth embodiment of a printing ribbon spool according to this invention showing a modified form of the construction illustrated in FIG. 13.
Figure 16:
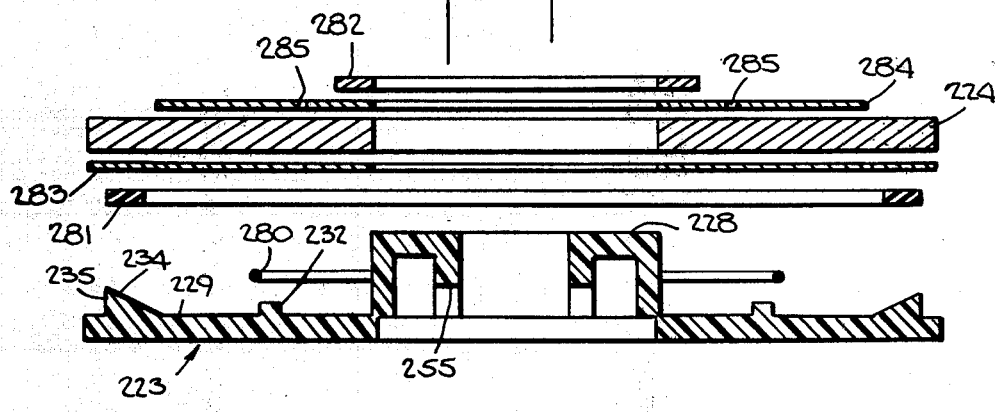
FIG. 16 is an exploded perspective view of the cap, gasket, booster, pad and ink impervious discs sub-assembly shown in FIG. 15.
Figure 17:
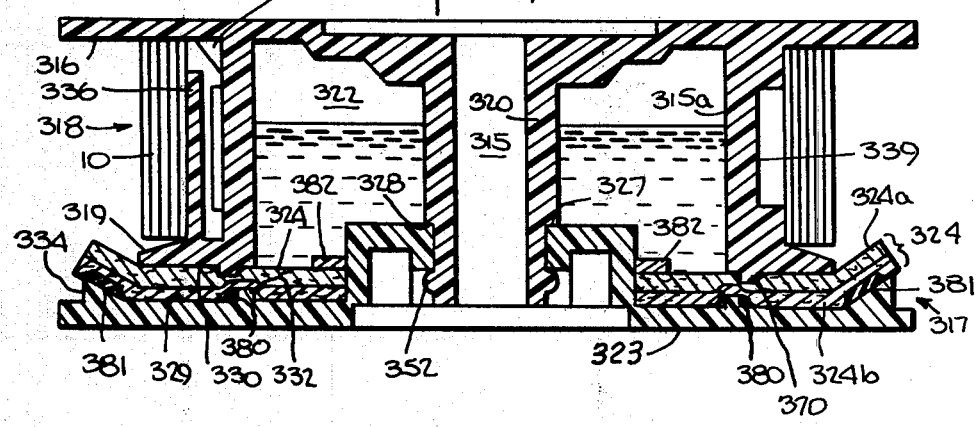
FIG. 17 is an axial cross-section view of a fifth embodiment of a printing ribbon spool according to this invention showing a still further modified form of the construction illustrated in FIG. 13 using two fibrous pads.
Figure 18:
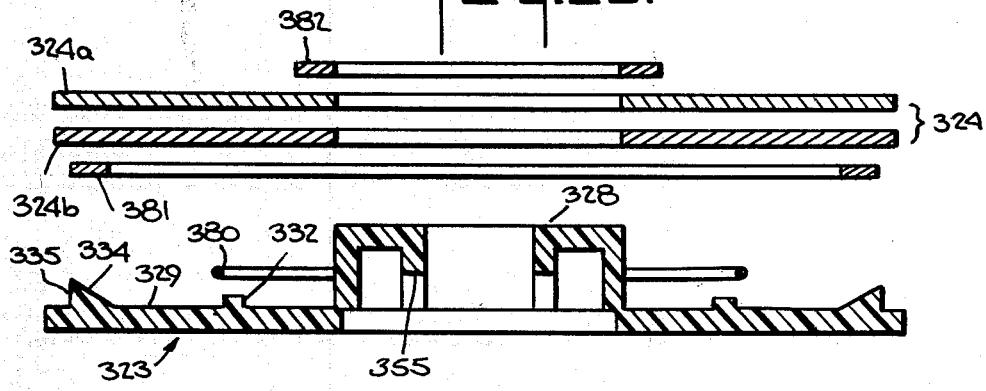
FIG. 18 is an exploded perspective view of the cap, gasket, booster and pad sub-assembly of FIG. 17.

Three embodiments of this invention employing inking pads of the now preferred spun-bonded fibrous materials are shown in FIGS. 13 and 14, and in FIGS. 15 and 16, and in FIGS. 17 and 18, respectively.

Although the locking feature has been dispensed with, as was also done in the second embodiment shown in FIG. 12, the third embodiment of this invention shown in FIGS. 13, 14 corresponds generally to the first and second embodiments shown in FIGS. 1–3 and 12, respectively, and has like parts. Therefore, in FIGS. 13, 14, the elements of this embodiment have been given the same reference characters as their respective corresponding elements in the embodiments illustrated in FIGS. 1–3 but with the addition of an initial number "1". Thus, the spool 111 has a hub 115, a hub wall 115*a*, flanges 116, 117 with a channel 118 therebetween, a flange element 119, a spindle tube 120, an ink reservoir cavity 122 and a tape retention arm 136 with associated fin 138 and flats 139.

Cap 123 also has a shoulder 128 and lower surface 155, and the body assembly has a shoulder 127 and a rib 152 for the same purpose as in the embodiment in FIGS. 1–3. The central opening in washer 124 is sufficiently small in the embodiment of FIGS. 13, 14 so that the radially inner part of washer 124 lies in the ink reservoir 122 at the bottom thereof. The hub wall 115*a* has a depending circular rib 170 disposed opposite an upstanding circular rib 132 on cap 123. A neoprene O-ring 180 having a diameter just sufficient to fit snugly around the outside of rib 132 is provided to seal the lower surface of metering washer 124 against ink leakage therepast and to accommodate manufacturing tolerances. Together ribs 132 and 170 and O-ring 180 serve as a dam to prevent ink leakage along the surfaces of the metering washer 124 and to compensate for variations in manufacturing tolerances in the washer 124 and the spool 111, so that the surface of the metering washer 124 is always contact or compressed slightly by the ribs 170 and 132 and by the O-ring 180 to prevent ink leakage from the reservoir 122.

In the embodiment of FIGS. 13 and 14 too, the cap 123 and lower flange element 119 are constructed to tilt or cock the outer periphery of the metering washer 124 upwardly at a slight angle. At its outer periphery, cap 123 has an upwardly projecting circular rib 134 which, as shown, is triangular in radial cross-section and slopes upwardly from the surface 129 to provide an enlarged thickness at the radially outermost periphery 135 of the rib 134. The outer periphery of flange element 119 terminates in the axial cylinder in which rib 134 commences. The rib 134 and element 119, as appears best in FIG. 13, cooperate to tilt or cock up the outer periphery of washer 124.

In this embodiment an auxiliary booster washer 181 is provided. This booster washer 181 has an internal diameter at least as large as the external diameter of flange element 119 and is positioned to underlie the pad 124 near its outer periphery to further enhance the distance that this outer periphery is cocked up. In this way booster washer 181 increases the effect of rib 134. If desired for a particular application, rib 134 could be made larger and the booster washer 181 dispensed with, but the booster washer 181 offers the practical advantage of permitting the height of cock-up of the outer periphery of pad 124 to be varied by the simple expedient of selecting booster washers 181 of different thicknesses while using a standard thickness of the rib 134 and consequently minimizing the need for different cap molds in manufacture.

There is also provided in this embodiment a cardboard washer 182 which does not contribute to the operation of the inking spool 111 but renders assembly in manufacture easier. As appears in FIGS. 13 and 14, this cardboard washer 182 has an internal diameter sufficient to fit snugly against the outer cylindrical surface of the shoulder 128 and overlying the metering pad 124 with a press fit on that outer cylindrical surface. Consequently, when assembling the cap 123, the O-ring 180, the booster washer 181, the metering washer 124 and the cardboard washer 182, the cardboard washer 182 can be pressed down upon the upper surface of the metering washer 124 with a press fit on the outer cylindrical surface of shoulder 128 to hold the various washers 180,181 snugly on the cap 123 until the cap 123 is assembled onto the hub 115.

The following specific printing ribbon spool 111 constructed as in the embodiment of FIGS. 13 and 14 and designed for use on a Teletype model 32/33 machine will further illustrate the invention. Shoulders 127 and 128 were constructed and arranged to leave a design gap of 0.073 inches between lower surface 130 of flange element 119 and upper surface 129 of cap 123. A type 10 TYVEK metering washer 124 was used. Type 10 TYVEK is a tough, dense and somewhat stiff, paper-like sheet, produced from fine, interconnected fibers which are densely packed. It has a smooth surface, and compared with most fabrics, its air permeability is low and its moisture-vapor transmission is similar to that of coated papers. In this specific spool 111 the TYVEK washer 124 was style 1085-D TYVEK having a nominal thickness of 0.010". Rib 170 projected downwardly 0.005" from the lower surface 130. The washer 124 had an internal diameter of $\frac{5}{8}$" and an external diameter of 1 31/32". Circular rib 132 projected upwardly from the surface 129 a distance of 0.102" and was disposed opposite a notch in rib 170 to help seal the surfaces of washer 124. A neoprene O-ring 180 had an internal diameter of 1.250" to fit around rib 132 having an external diameter of 1.250", and O-ring 180 had a cross-sectional diameter of 0.070".

A booster ring 181 of FAIRPRENE buna N BN 5039 gasketing material 0.050" thick and 1.625" in internal diameter and 1.8906" in external diameter was used. FAIRPRENE 5039 is a sheet meterial of nylon fabric coated on both upper and lower surfaces with buna N rubber, and is described in the DuPont handbook "FAIRPRENE, A HANDBOOK OF FLEXIBLE ELASTOMER DIAPHRAGMS" no. E-10136 which is incorporated herein by this reference.

Although the locking feature has been dispensed with, as was also done in the second embodiment shown in FIG. 12, the fourth embodiment of this invention shown in FIGS. 15, 16 corresponds generally to the first and second embodiments shown in FIGS. 1–3 and 12, respectively, and has like parts. Therefore, in FIGS. 15, 16, the elements of this embodiment have been given the same reference characters as their respective corresponding elements in the embodiments illustrated in FIGS. 1–3 but with the addition of an initial number "2". Thus, the spool 211 has a hub 215, a hub wall 215*a*, flanges 216, 217 with a channel 218 therebetween, a flange element 219, a spindle tube 220, an ink reservoir cavity 222, a lower surface 230 and a tape retention arm 236 with associated fin 238 and flats 239.

Cap 223 also has a shoulder 228 and a lower surface 255, and the body assembly has a shoulder 227 and a rib 252 for the same purpose as in the embodiment in FIG. 1–3. The central opening in washer 224 is sufficiently small in the embodiment of FIGS. 15, 16 so that the radially inner part of washer 224 lies in the ink reservoir 222 at the bottom thereof. The hub wall 215*a* has a depending circular rib 270 disposed opposite an upstanding circular rib 232 on cap 223. A neoprene O-ring 280 having a diameter just sufficient to fit snugly around the outside of rib 232 is provided to seal the lower surface of metering washer 224 against ink leakage therepast and to accommodate manufacturing tolerances.

Together ribs 232 and 270 and O-ring 280 serve as a dam to prevent ink leakage along the surfaces of the ink impervious isolating washers 283,284, to be described, and to compensate for variations in manufacturing tolerances, so that the metering washer 224 and the isolating washers 283,284 are always compressed slightly to prevent ink leakage from the reservoir 222.

In the embodiment of FIGS. 15 and 16 too, the cap 223 and lower flange element 219 are constructed to tilt or cock the outer periphery of the metering washer 224 upwardly at a slight angle. At its outer periphery, cap 223 has an upwardly projecting circular rib 234 which, as shown, is triangular in radial cross-section and slopes upwardly from the surface 229 to provide an enlarged thickness at the radially outermost periphery 235 of the rib 234. The outer periphery of flange element 219 terminates in the axial cylinder in which rib 234 commences. The rib 234 and element 219, as appears best in FIG. 15, cooperate to tilt or cock up the outer periphery of washer 224.

In this embodiment an auxiliary booster washer 281 is provided. This booster washer 281 has an internal diameter at least as large as the external diameter of flange element 219 and is positioned to underlie the pad 224 near its outer periphery to further enhance the distance that this outer periphery is cocked up. In this way booster washer 281 increases the effect of rib 234. If desired for a particular application, rib 234 could be made larger and the booster washer 281 dispensed with, but the booster washer 281 offers the practical advantage of permitting the height of cock-up of the outer periphery of pad 224 to be varied by the simple expedient of selecting booster washers 281 of different thicknesses while using a standard thickness for the rib 234 and consequently minimizing the need for different cap molds in manufacture.

There is also provided in this embodiment a cardboard washer 282 of the same construction and for the same purpose as washer 182 in the embodiment of FIGS. 13, 14.

In the embodiment illustrated in FIGS. 15, 16, a more open fibrous metering washer 224 which transmits ink relatively freely is employed. Reemay is an example of a product of this type. When using such a product it has been found desirable to employ additional neoprene isolating discs or washers, next to be described, to help control the ink flow with such discs. These discs consist of a first thin neoprene washer 283 underlying and in contact with the lower surface of the Reemay washer 224. This neoprene washer 283 has an internal diameter equal to the internal diameter of the washer 224 to underlie the washer 224. A second neoprene washer 284 overlies and is in contact with the upper surface of the Reemay washer 224. This upper neoprene washer 284 has an internal diameter the same as the internal diameter of the Reemay washer 224, but its external diameter is nearly equal to the external diameter of the flange element 219, so that the Reemay washer 224 projects outwardly from under washer 284 a substantial distance, so that the Reemay washer 224 can wipe the ribbon 10 as it advances to or from the spool 211.

As best appears in FIG. 16, the upper neoprene washer 284 has a series of small holes 285 therethrough from its upper to its lower surface at the portion of the neoprene washer 284 that lies within the ink reservoir 222. Thus, ink from the reservoir 222 is confined to pass through these small holes 285 (four being provided spaced at 90° intervals in the embodiment shown) to enter the Reemay washer 224, and the neoprene washer 285 otherwise serves to isolate the Reemay washer 224 from the ink in the reservoir 222 save at these small holes 285. The ink is confined between the neoprene washers 283 and 284 and in the Reemay metering washer 224 until it reaches the outer periphery of the upper neoprene washer 284 at which point the ink can be delivered from the Reemay metering washer 224 to the ribbon 10.

In the following specific ribbon spool constructed as in the embodiment of FIGS. 15 and 16, and designed for use on an Extel machine, the spool elements and O-ring are proportioned as in the above-described Teletype Model 32/33 embodiment, and a 0.032" thick Reemay #2470 metering washer 224 having an internal diameter of $\frac{5}{8}$" and an external diameter of 1 31/32" is used with two isolating washers 283, 284 each being 0.006" thick and each having an internal diameter of 0.625" and an external diameter of 1 31/32" for washer 283 and 1 23/32" for washer 284, and the upper isolating washer 284 having 4 holes 285 therethrough each 0.0081" in diameter centered 0.086" radially from the inner diameter of washer 284. In this embodiment the booster ring 282 had a thickness of 0.0625" and was made of urethane; otherwise it was identical to booster ring 182 of the embodiment of FIGS. 13 and 14.

Although the locking feature has been dispensed with, as was also done in the second embodiment shown in FIG. 12, the fifth embodiment of this invention shown in FIGS. 17, 18 corresponds generally to the first and second embodiments shown in FIGS. 1–3 and 12, respectively, and has like parts. Therefore, in FIGS. 17, 18, the elements of this embodiment have been given the same reference characters as their respective corresponding elements in the embodiments illustrated in FIGS. 1–3 but with the addition of an initial number "3". Thus, the spool 311 has a hub 315, a hub wall **315*a*, flanges 316, 317 with a channel 318 therebetween, a flange element 319, a spindle tube 320, an ink reservoir cavity 322, a lower surface 330 and a tape retention arm 336 with associated fin 338 and flats 339. A lower surface 355, corresponding to the lower surface 55 of FIG. 1 is also included in cap 323**.

Cap 323 also has a shoulder 328, and the body assembly has a shoulder 327, and a rib 352 for the same purpose as in the embodiment of FIGS. 1–3. The central opening in composite washer 324, to be described, is sufficiently small in the embodiment of FIGS. 17, 18 so that the radially inner part of washer 324 lies in the ink reservoir 322 at the bottom thereof. The hub wall **315*a* has a depending circular rib 370 disposed opposite an upstanding circular rib 332 on cap 323. A neoprene O-ring 380 having a diameter just sufficient to fit snugly around the outside of rib 332 is provided to seal the lower surface of metering washer 324 against ink leakage therepast and to accommodate manufacturing tolerances. Together ribs 332 and 370 and O-ring 380 serve as a dam to prevent ink leakage along the surfaces of the metering washer 324 and to compensate for variations in manufacturing tolerances in the washer 324 and the spool 311, so that the surface of the metering washer 324 is always contacted or compressed slightly by the rib 370 and by the O-ring 380 to prevent ink leakage from the reservoir 322. Washer 324 is in two parts, 324*a* and 324*b***.

In the embodiment of FIGS. 17 and 18 too, the cap 323 and lower flange element 319 are constructed to tilt or cock the outer periphery of the metering washer 324 upwardly at a slight angle. At its outer periphery, cap 323 has an upwardly projecting circular rib 334 which, as shown, is triangular in radial cross-section and slopes upwardly from the surface 329 to provide an enlarged thickness at the radially outermost periphery 335 of the rib 334. The outer periphery of flange element 319 terminates in the axial cylinder in which rib 334 commences. The rib 334 and element 319, as appears best in FIG. 17, cooperate to tilt or cock up the outer periphery of washer 324.

In this embodiment an auxiliary booster washer 381 is provided. This booster washer 381 has an internal diameter at least as large as the external diameter of flange element 319 and is positioned to underlie the pad 324 near its outer periphery to further enhance the distance that this outer periphery is cocked up. In this way booster washer 381 increases the effect of rib 334. If desired for a particular application, rib 334 could be made larger and the booster washer 381 dispensed with, but the booster washer 381 offers the practical advantage of permitting the height of cock-up of the outer periphery of pad 324 to be varied by the simple expedient of selecting booster washers 381 of different thicknesses while using a standard thickness for the rib 334 and consequently minimizing the need for different cap molds in manufacture.

There is also provided in this embodiment a cardboard washer 382 of the same construction and for the same purpose as washer 182 in the embodiment of FIGS. 13, 14.

In the following specific printing ribbon spool 311 constructed as in the embodiment of FIGS. 17 and 18 and designed for use on a Teletype Model 28/35 machine the ribbon spool 311 was identical in construction, arrangement and dimensions to the above-described Teletype Model 32/33 embodiment but with the single exception that two of the TYVEK metering washers **324*a* and 324*b* as described above for use on the Teletype Model 32/33 were employed instead of a single TYVEK washer 124**.

I claim:

1. A printing ribbon spool comprising a spool body, said spool body having a hub with an ink reservoir and spaced flange portions extending radially outwardly from said hub, said hub being between said spaced flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as a lower flange portion with respect to said upper flange portion when said spool is in said operating position, said ribbon having an upper portion corresponding to the upper flange portion and a lower portion corresponding to the lower flange portion, an ink delivery pad at said lower flange portion as the sole ink delivery means for said spool, said ink delivery pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the ink delivery pad in the path of ribbon advance, said ink delivery pad communicating in ink receiving relation with the ink reservoir to receive ink from said ink reservoir when said spool is in said operating position and convey the ink to said exposed portion of the ink delivery pad, said spool further including an ink impervious member disposed above said ink delivery pad, said ink impervious member being disposed between said ink delivery pad and the link reservoir whereby said ink impervious member isolates said ink delivery pad from ink in the ink reservoir, said ink impervious member having at least one opening there through to permit ink to pass therethrough from the ink reservoir to said ink delivery pad.

2. A printing ribbon spool in accordance with claim 1 in which said ink delivery pad is a spun-bonded fibrous sheet.

3. A printing ribbon spool in accordance with claim 2 in which said ink delivery pad includes two spun-bonded fibrous sheets.

4. A printing ribbon spool in accordance with claim 1 in which said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said ink delivery pad being a washer-like pad having a central opening, said washer-like pad being disposed between said first and second outwardly projecting flange elements, said portion of said washer-like pad exposed in ribbon contacting position being an exposed outer peripheral portion of said washer-like pad lying radially outwardly of the periphery of said first outwardly projecting flange element, said support means projecting upwardly from said second outwardly projecting flange element toward the path of ribbon advance toward said surface and underlying said exposed portion of said washer-like pad to support said exposed portion of said washer-like pad in position to wipe the lower portion of the ribbon as said ribbon advances therepast.

5. A printing spool in accordance with claim 4 in which said ink reservoir is a closed reservoir, and said ink reservoir is disposed inwardly of the washer-like pad's central opening, the walls defining said ink reservoir having at least one ink escape passage therethrough adjacent said washer-like pad and communicating between the interior of said ink reservoir and an inner portion of the washer-like pad to feed ink from said ink reservoir to said washer-like pad.

6. A printing ribbon spool in accordance with claim 4 in which said support means is an upwardly projecting rib underlying said washer-like pad near the radially outermost periphery of said washer-like pad to cock upwardly over said upwardly projecting rib the outer exposed periphery of said washer-like pad.

7. A printing ribbon spool in accordance with claim 6 in which said washer-like pad has a generally cylindrical outer surface and is annular in plan, whereby the tipped up edge presents a generally inverted V-shaped section of the washer-like pad to the lower portion of the ribbon.

8. A spool in accordance with claim 4 in which said hub has a central spindle receiving tube and an enlarged inverted conical cavity at the upper end of the spindle receiving tube to receive beneath the plane of the upper surface of the spool a locking mechanism to lock the spool on a business machine spindle.

9. A printing ribbon spool in accordance with claim 4 in which said ink delivery pad is a spun-bonded fibrous sheet.

10. A printing ribbon spool in accordance with claim 4 in which said ink delivery pad includes two spun-bonded fibrous sheets.

11. An inking device comprising a spool-like body, said body having a hub and a lower flange extending radially outwardly from said hub, said hub being above said flange and having a surface to receive ink delivery means thereon above said flange, an ink reservoir in said hub, means to receive ink from said reservoir and to transfer the ink to the ink delivery means, said lower flange having a separable cap member to close said ink reservoir, a first depending rib on a wall defining said reservoir, said depending rib projecting toward said cap member, a cooperating upstanding rib on said cap member adjacent said depending rib and sealing thereagainst to close said reservoir against ink leakage past said ribs, said depending rib and said upstanding rib each having at least one opening therethrough, the opening through said ribs being positioned to be aligned to form an ink escape passage from said reservoir through said ribs, said upstanding rib being movable relative to said depending rib from a closed position in which the opening in one rib is closed by a facing portion of the other rib to close the reservoir to an open position in which the openings are so aligned.

12. A device in accordance with claim 11 in which said means to receive ink from said reservoir and to transfer ink to the ink delivery means is a washer-like pad disposed at said lower flange and having a portion thereof exposed to contact a lower portion of the ink delivery means, and the central opening of the washer-like pad surrounds said cooperating ribs so ink passing through said ink escape passage is transferred to said pad.

13. A device in accordance with claim 11 in which said opening in said depending rib is a notch in the lower edge of said depending rib and in which said opening in said upstanding rib is a notch in the upper edge of said upstanding rib.

14. A device in accordance with claim 13 in which there are a plurality of said notches in both said upstanding rib and said depending rib alignable to form a plurality of ink escape passages from said reservoir through said ribs.

15. A device in accordance with claim 13 in which one of said ribs has a locking block thereon and the other of said ribs has a first block positioning notch and a second block positioning notch in the surface thereof facing said block, said first block positioning notch being positioned to receive said block when said openings are in the closed position, said first positioning notch having a sloping wall on the side thereof adjacent said second positioning notch, said second positioning notch being positioned to receive said block when said openings are in the open position, whereby said ribs may be moved relative to each other to move said block from said first positioning notch in a passage closing position past said sloping wall to said second positioning notch in a passage open position.

16. A printing ribbon device comprising in combination a printing ribbon spool and a printing ribbon having a type slug impact area in an upper portion of said ribbon, said ribbon spool having a spool body, said body having a hub and an upper and a lower flange each extending radially outwardly from said hub, said hub being between said flanges and having a surface to receive said ribbon wound thereon between said flanges, a pad at said lower flange and having a portion thereof exposed in ribbon contacting position near the outer edge of said lower flange, an ink reservoir in said hub, said pad communicating in ink receiving relation with the ink reservoir to receive ink from said reservoir and convey the ink to said exposed ribbon contacting portion of the pad, means directing said ribbon to said spool to contact said exposed portion of said pad with a lower portion of said ribbon by advancing the ribbon through a zone slightly below the zone of ribbon wrap on the spool and with the ribbon's lower portion in contact with the exposed portion of the pad to transfer ink from said pad to said lower portion of said ribbon, said ribbon having capillaries to transfer ink upwardly of said ribbon to said type slug impact area of said ribbon.

17. A printing ribbon spool in accordance with claim 16 in which said pad is a pad of cellular plastic material.

18. A printing ribbon spool in accordance with claim 17 in which said pad is a pad of cellular polyurethane.

19. A printing ribbon spool in accordance with claim 16 in which said pad is a pad of spun-bonded fibrous sheet.

20. A printing ribbon spool in accordance with claim 16 in which said lower radially outwardly extending flange comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange, and said pad being disposed between said first and second outwardly projecting flange elements, said portion of said pad exposed in ribbon contacting position being the exposed outer peripheral portion of said pad lying radially outwardly of the periphery of said first outwardly projecting flange element and in position to be wiped by said lower portion of said ribbon as the ribbon advances therepast.

21. A printing spool in accordance with claim 20 in which said reservoir is a closed reservoir, said pad is a flat washer-like pad and said reservoir is disposed inwardly of the washer-like pad's central opening, the walls defining said reservoir having at least one ink escape passage therethrough adjacent said pad and communicating between the interior of said ink reservoir and an inner portion of the washer-like pad to feed ink from said reservoir to said pad.

22. A printing ribbon spool in accordance with claim 21 in which said hub in at least one area of the hub surface on which the ribbon is to be wound has a plurality of radially outwardly extending ridges, and valleys between said ridges to drain ink squeezed from the ribbon back to said pad.

23. A printing ribbon spool in accordance with claim 20 in which said second outwardly extending flange element has an upwardly projecting rib underlying said pad near the radially outermost periphery of said pad to cock the outer exposed periphery of said pad upwardly over said upwardly projecting rib.

24. A printing ribbon spool in accordance with claim 20 in which said pad has a generally cylindrical outer surface and is annular in plan, whereby the tipped up edge presents a generally inverted V-shaped section of the pad to the lower portion of the ribbon.

25. A printing ribbon spool in accordance with claim 20 in which said hub has a spindle receiving central tube and an enlarged invented conical cavity at the upper end of the spindle receiving tube to receive beneath the plane of the upper surface of the spool a locking mechanism to lock the spool on a business machine spindle.

26. A printing spool in accordance with claim 20 in which an inner portion of said pad lies in the ink reservoir, said second outwardly projecting flange element having an upwardly extending rib, said first outwardly projecting flange element having a downwardly extending rib facing said upwardly extending rib and mating therewith, said ribs contacting the surfaces of said pad and sealing the surfaces of said pad against ink leakage thereacross to confine ink passage therepast to the internal structure of the pad.

27. A printing ribbon spool in accordance with claim 26 in which said hub in at least one area of the hub surface on which the ribbon is to be wound has a plurality of radially outwardly extending ridges, and valleys between said ridges to drain ink squeezed from the ribbon back to said pad.

28. A printing ribbon spool in accordance with claim 24 including an upper ink impervious member disposed above said pad, said upper ink impervious member being disposed between said pad and the ink reservoir whereby said upper ink impervious member isolates said pad from ink in the ink reservoir, said upper ink impervious member having at least one opening therethrough to permit ink to pass therethrough from the reservoir to said pad.

29. A printing ribbon device comprising in combination a let-off printing ribbon spool and a wind-up printing ribbon spool, a printing ribbon extending therebetween, each said spool having a spool body, said body having a hub and an upper and a lower flange each extending radially outwardly from said hub, said hub being between said flanges and having a surface to receive said ribbon wound thereon between said flanges, a pad at said lower flange and having a portion thereof exposed in ribbon contacting position near the outer periphery of said lower flange, walls of said hub defining an ink receiving cavity, said pad communicating in ink receiving relation with the ink receiving cavity to receive ink from said cavity and convey the ink to said exposed ribbon contacting portion of the pad, means directing said ribbon to each said spool to contact said exposed portion of said pad with a lower portion of said ribbon by advancing the ribbon through a zone slightly below the zone of ribbon wrap on the spool and with the ribbon's lower portion in contact with the exposed portion of the pad to transfer ink from said pad to said lower portion of said ribbon, said ribbon having capillaries to transfer ink upwardly of said ribbon to a type slug impact area of said ribbon.

30. A method of replenishing ink to a printing ribbon which comprises storing ink in a spool for the ribbon in an ink reservoir located generally inwardly of a wall of the spool on which the ribbon is wound, transmitting ink from the reservoir to an ink receiving portion of a pad, transmitting ink through the pad to a portion thereof lying exposed beneath the ribbon and in the path of the ribbon as the ribbon passes the pad, contacting the exposed portion of the pad with a lower portion of the ribbon as the ribbon travels therepast in operation of a business machine by advancing the ribbon through a zone slightly below the zone of ribbon wrap on the spool and with the ribbon's lower portion in contact with the exposed portion of the pad and transferring ink in the ribbon from the exposed portion of the pad to the lower portion of the ribbon as they so contact, and conveying ink upwardly of said ribbon from said lower portion thereof to a type slug impact area thereof by capillary action in the ribbon.

31. A method in accordance with claim 30 including bending said ribbon so that a narrow area of the ribbon at its lower edge contacts the exposed portion of the pad lying in the ribbon path, and rubbing and flexing the exposed portion of the pad with the ribbon as the ribbon travels past the pad.

32. A method in accordance with claim 31 in which said ink is conveyed from the reservoir through ink transmitting channels in a wall of the reservoir to the ink receiving portion of the pad disposed outside the reservoir walls.

33. A method in accordance with claim 3 in which said pad is disposed at least partially in the bottom of the reservoir and has a portion in the ink and projects outwardly of the reservoir and terminates in the portion thereof lying exposed in the path of the ribbon as the ribbon passes the pad, and conveying ink from said reservoir through the pad.

34. A method in accordance with claim 33 including sealing the surfaces of the pad between the reservoir and the ribbon to confine ink passage therebetween to the interior of the pad.

35. A method in accordance with claim 30 which comprises draining ink pressed from the ribbon back to the pad by means of corrugations in a wall of the spool on which the ribbon is wound.

36. A method of replenishing ink to a printing ribbon of a business machine at a supply printing ribbon spool and at a take-up printing ribbon spool which comprises storing ink in each of the supply and take-up ribbon spools in an ink reservoir located generally inwardly of a wall of the spool on which the ribbon is wound, transmitting ink from each reservoir to an ink receiving portion of a pad at each spool, transmitting ink through the pad to a portion thereof lying exposed beneath the ribbon and in the path of the ribbon as the ribbon passes the pad, at each spool contacting the exposed portion of the the pad with a lower portion of the ribbon as the ribbon travels therepast in operation of the business machine by advancing the ribbon through a zone slightly below the zone of ribbon wrap on the spool and with the ribbon's lower portion in contact with the exposed portion of the pad and transferring ink to the ribbon from the exposed portion of the pad to the lower portion of the ribbon as they so contact as the ribbon is let-off and wound-up, and conveying ink upwardly of said ribbon from said lower portion thereof to a type slug impact area thereof by capillary action in the ribbon.

37. A method in accordance with claim 36 including at each spool bending said ribbon so that a narrow area of the ribbon at its lower edge contacts the exposed portion of the pad lying in the ribbon path, and rubbing and flexing the exposed portion of the pad with the ribbon as the ribbon travels past the pad.

38. A method in accordance with claim 36 in which said ink is conveyed from each reservoir through ink transmitting channels in a wall of the reservoir to the ink receiving portion of the pad disposed outside the reservoir walls.

39. A method in accordance with claim 36 in which said pad at each spool is disposed at least partially in the bottom of the reservoir and has a portion in the ink and projects outwardly of the reservoir and terminates in the portion thereof lying exposed in the path of the ribbon as the ribbon passes the pad, and conveying ink from said reservoir through the pad.

40. A method in accordance with claim 39 including at each spool sealing the surfaces of the pad between the reservoir and the ribbon to confine ink passage therebetween to the interior of the pad.

41. A method in accordance with claim 39 which comprises draining ink pressed from the ribbon back to the pad by means of corrugations in a wall of the spool on which the ribbon is wound.

42. A printing ribbon spool comprising a spool body, said spool body having a hub with an ink reservoir and spaced flange portions extending radially outwardly from said hub, said hub being between said spaced flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as a lower flange portion with respect to said upper flange portion when said spool is in said operating position, said ribbon having an upper portion corresponding to the upper flange portion and a lower portion corresponding to the lower flange portion, a pad at said lower flange portion as the sole ink delivery means for said spool, said pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the pad in the path of ribbon advance, said pad communicating in ink receiving relation with the ink reservoir to receive ink from said ink reservoir when said spool is in said operating position and convey the ink to said exposed portion of the pad and wherein said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said pad being a washer-like pad having a central opening, said washer-like pad being disposed between said first and second outwardly projecting flange elements, said portion of said pad exposed in ribbon contacting position being an exposed outer peripheral portion of said pad lying radially outwardly of the periphery of said first outwardly projecting flange element, said support means projecting upwardly from said second outwardly projecting flange element toward the path of ribbon advance toward said surface and underlying said exposed portion of said pad to support said exposed portion of said pad in position to wipe the lower portion of the ribbon as said ribbon advances therepast and wherein said ink reservoir is a closed reservoir, and said ink reservoir is disposed inwardly of the washer-like pad's central opening, the walls defining said ink reservoir having at least one ink escape passage therethrough adjacent said pad and communicating between the interior of said ink reservoir and an inner portion of the washer-like pad to feed ink from said ink reservoir to said pad and wherein said hub in at least one area of the hub surface on which the ribbon is to be wound has a plurality of radially outwardly extending ridges, and valleys between said ridges to drain ink squeezed from the ribbon back to said pad.

43. A printing ribbon spool comprising a spool body, said spool body having a hub with a ink reservoir and spaced flange portions extending radially outwardly from said hub, said hub being between said spaced flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as a lower flange portion with respect to said upper flange portion when said spool is in said operating position, said ribbon having an upper portion corresponding to the upper flange portion and a lower portion corresponding to the lower flange portion, a pad at said lower flange portion as the sole ink delivery means for said spool, said pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the pad in the path of ribbon advance, said pad communicating in ink receiving relation with the ink reservoir to receive ink from said ink reservoir when said spool is in said operating position and convey the ink to said exposed portion of the pad and wherein said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said pad being a wasker-like pad having a central opening, said washer-like pad being disposed between said first and second outwardly projecting flange elements, said portion of said pad exposed in ribbon contacting position being an exposed outer peripheral portion of said pad lying radially outwardly of the periphery of said first outwardly projecting flange element, said support means projecting upwardly from said second outwardly projecting flange element toward the path of ribbon advance toward said surface and underlying said exposed portion of said pad to support said exposed portion of said pad in position to wipe the lower portion of the ribbon as said ribbon advances therepast, and wherein an inner portion of said pad lies in the ink reservoir, said second outwardly projecting flange element having an upwardly extending rib, said first outwardly projecting flange element having a downwardly extending rib facing said upwardly extending rib and mating therewith, said ribs contacting the surfaces of said pad and sealing the surfaces of said pad against ink leakage thereacross to confine ink passage therepast to the internal structure of the pad.

44. A printing ribbon spool in accordance with claim 43 in which said hub in at least one area of the hub surface on which the ribbon is to be wound has a plurality of radially outwardly extending ridges, and valleys between said ridges to drain ink squeezed from the ribbon back to said pad.

45. A printing ribbon spool comprising a spool body, said spool body having a hub with an ink reservoir and spaced flange portions extending radially outwardly from said hub, said hub being between said spaced flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as a lower flange portion with respect to said upper flange portion when said spool is in said operating position, said ribbon having an upper portion corresponding to the upper flange portion and a lower portion corresponding to the lower flange portion, an ink delivery pad at said lower flange portion as the sole ink delivery means for said spool, said ink delivery pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the ink delivery pad in the path of ribbon advance, said ink delivery pad communicating in ink receiving relation with the ink reservoir to receive ink from said ink reservoir when said spool is in said operating position and convey the ink to said exposed portion of the ink delivery pad and wherein said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said ink delivery pad being a washer-like pad having a central opening, said washer-like pad being disposed between said first and second outwardly projecting flange elements, said portion of said ink delivery pad exposed in ribbon contacting position being an exposed outer peripheral portion of said ink delivery pad lying radially outwardly of the periphery of said first outwardly projecting flange element, said support means projecting upwardly from said second outwardly projecting flange element toward the path of ribbon advance toward said surface and underlying said exposed portion of said ink delivery pad to support said exposed portion of said ink delivery pad in position to wipe the lower portion of the ribbon as said ribbon advances therepast, said spool further including an upper ink impervious member disposed above said ink delivery pad, the upper ink impervious member being disposed between said ink delivery pad and the ink reservoir whereby said upper ink impervious member isolates said ink delivery pad from ink in the ink reservoir, said upper ink impervious member having at least one opening therethrough to permit ink to pass therethrough from the ink reservoir to said ink delivery pad.

46. A printing ribbon spool in accordance with claim 45 including a booster ring overlying said support means and underlying the outer periphery of said ink delivery pad where said support means projects upwardly toward the path of ribbon advance.

47. A printing ribbon spool comprising a spool body, said spool body having a hub with an ink reservoir and spaced flange portions extending radially outwardly from said hub, said hub being between said space flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as a lower flange portion with respect to said upper flange portion when said spool is in said operating position, said ribbon having an upper portion corresponding to the upper flange portion and a lower portion corresponding to the lower flange portion, a pad at said lower flange portion as the sole ink delivery means for said spool, said pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the pad in the path of ribbon advance, said pad communicating in ink receiving relation with the ink reservoir to receive ink from said ink reservoir when said spool is in said operating position and convey the ink to said exposed portion of the pad and wherein said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said pad being a washer-like pad having a central opening, said washer-like pad being disposed between said first and second outwardly projecting flange elements, said portion of said pad exposed in ribbon contacting position being an exposed outer peripheral portion of said pad lying radially outwardly of the periphery of said first outwardly projecting flange element, said support means projecting upwardly from said second outwardly projecting flange element toward the path of ribbon advance toward said surface and underlying said exposed portion of said pad to support said exposed portion of said pad in position to wipe the lower portion of the ribbon as said ribbon advances therepast and wherein pad is a spun-bonded fibrous sheet, said spool further including a booster ring overlying said support means and underlying the outer periphery of said spun-bonded fibrous sheet where said support means projects upwardly toward the path of ribbon advance.

48. A printing ribbon spool comprising a spool body, said spool body having a hub with an ink reservoir and spaced flange portions extending radially outwardly from said hub, said hub being between said spaced flange portions and having a surface to receive a ribbon wound thereon between said spaced flange portions to define a zone of ribbon wrap, said ribbon advancing from said zone of ribbon wrap when said spool is unwound, one of said flange portions being defined as an upper flange portion when said spool is in an operating position about a vertical axis and another of said flange portions being defined as lower flange portion with respect to said upper flange portion when said spool is in said operating position, said ribbon having an upper portion corresponding to the upper flange portion and a lower portion corresponding to the lower flange portion, a pad at said lower flange portion as the sole ink delivery means for said spool, said pad having an exposed portion in the path of the advancing ribbon to contact said lower portion of said ribbon as said ribbon advances therepast, said lower flange portion being disposed below the zone of ribbon wrap on the spool, said lower flange portion including support means for supporting said exposed portion of the pad in the path of ribbon advance, said pad communicating in ink receiving relation with the ink reservoir to receive ink from said ink reservoir when said spool is in said operating position and convey the ink to said exposed portion of the pad and wherein said lower flange portion comprises first and second outwardly projecting flange elements, said second outwardly projecting flange element projecting radially outwardly a greater distance from the axis of said spool than said first outwardly projecting flange element, said first and second outwardly projecting flange elements being spaced apart axially of said spool with said first outwardly projecting flange element disposed between said second outwardly projecting flange element and said upper flange portion, said pad being a washer-like pad having a central opening, said washer-like pad being disposed between said first and second outwardly projecting flange elements, said portion of said pad exposed in ribbon contacting position being an exposed outer peripheral portion of said pad lying radially outwardly of the periphery of said first outwardly projecting flange element, said support means projecting upwardly from said second outwardly projecting flange element toward the path of ribbon advance toward said surface and underlying said exposed portion of said pad to support said exposed portion of said pad in position to wipe the lower portion of the ribbon as said ribbon advances therepast and wherein said pad includes two spun-bonded fibrous sheets, said spool further including a booster ring overlying said support means and underlying the outer periphery of said spun-bonded fibrous sheet where said support means projects upwardly toward the path of ribbon advance.

* * * * *